US012643140B2

(12) United States Patent
Kasahara et al.

(10) Patent No.: US 12,643,140 B2
(45) Date of Patent: Jun. 2, 2026

(54) BINDING DEVICE

(71) Applicant: MAX CO., LTD., Tokyo (JP)

(72) Inventors: Akira Kasahara, Tokyo (JP); Kenichi Arai, Tokyo (JP); Shigeki Shindou, Tokyo (JP)

(73) Assignee: Max Co., Ltd., Tokyo (JP)

( * ) Notice: Subject to any disclaimer, the term of this patent is extended or adjusted under 35 U.S.C. 154(b) by 253 days.

(21) Appl. No.: 18/216,312

(22) Filed: Jun. 29, 2023

(65) Prior Publication Data

US 2024/0001430 A1 Jan. 4, 2024

(30) Foreign Application Priority Data

Jul. 1, 2022 (JP) ..... 2022-106761

(51) Int. Cl.
*B21F 7/00* (2006.01)

(52) U.S. Cl.
CPC ..... *B21F 7/00* (2013.01)

(58) Field of Classification Search
CPC ..... B21F 7/00; B21F 15/04; B65B 13/185; B65B 13/187; B65B 13/22; B65B 13/28; B65B 13/285; E04G 21/123
See application file for complete search history.

(56) References Cited

U.S. PATENT DOCUMENTS 4,685,493 A * 8/1987 Yuguchi ..... E04G 21/123 140/57
4,774,824 A 10/1988 Ritter et al.
4,953,598 A * 9/1990 McCavey ..... E04G 21/123 140/57
6,105,344 A * 8/2000 Maeda ..... B65B 13/18 53/589
6,401,766 B1 * 6/2002 Ishikawa ..... E04G 21/122 140/57

(Continued)

FOREIGN PATENT DOCUMENTS

EP 3978705 A1 4/2022
JP 11-156743 A * 6/1999

(Continued)

OTHER PUBLICATIONS

Translation JP 11-156743A, Ishii et al. Jun. 1999.*

(Continued)

*Primary Examiner* — Edward T Tolan
(74) *Attorney, Agent, or Firm* — Banner & Witcoff, Ltd.

(57) ABSTRACT

A binding device includes a binding mechanism configured to feed a wire around a reinforcing bar, and to twist and bind the wire fed around the reinforcing bar, a binding mechanism moving part configured to move the binding mechanism between a binding position where binding of the reinforcing bar is performed and a retreat position distant from the reinforcing bar, and a wire pull-out part configured to pull out the wire wound on the reel. The wire pull-out part includes a transmission part to which an operation of the binding mechanism moving part is transmitted, and the transmission part is configured such that an amount of the wire pulled out by the wire pull-out part is different from an amount of movement of the binding mechanism moved by an operation of the binding mechanism moving part.

10 Claims, 32 Drawing Sheets

(56) References Cited

U.S. PATENT DOCUMENTS

| | | | | |
|---|---|---|---|---|
| 7,140,400 | B2 * | 11/2006 | Yokochi | E04G 21/122 140/57 |
| 8,047,239 | B2 * | 11/2011 | Hoyaukin | E04G 21/123 140/93.6 |
| 2019/0015922 | A1 | 1/2019 | Inoue et al. | |
| 2022/0106067 | A1 * | 4/2022 | Hamano | B65B 13/186 |
| 2022/0145649 | A1 | 5/2022 | Manabe et al. | |
| 2023/0286034 | A1 * | 9/2023 | Ito | B21F 15/06 |

FOREIGN PATENT DOCUMENTS

| | | | | |
|---|---|---|---|---|
| JP | 11-156744 | A | * | 6/1999 |
| JP | 2007-084241 | A | | 4/2007 |
| JP | 2013-035052 | A | | 2/2013 |
| JP | 2020076255 | A | | 5/2020 |
| JP | 2022-060996 | A | | 4/2022 |
| WO | 2017-155041 | A1 | | 9/2017 |

OTHER PUBLICATIONS

Dec. 7, 2023—(EP) Extended Search Report—App 23182719.7.
Aug. 8, 2023—(WO) Search Report—App PCT/JP2023/024295.
Aug. 8, 2023—(US) Written Opinion—App PCT/JP2023/024295.

* cited by examiner

BINDING DEVICE

CROSS-REFERENCE TO RELATED APPLICATIONS

This application is based upon and claims the benefit of priority from prior Japanese patent application No. 2022-106761, filed on Jul. 1, 2022, the entire contents of which are incorporated herein by reference.

TECHNICAL FIELD

The present invention relates to a binding device for binding a reinforcing bar with a wire.

BACKGROUND ART

For concrete buildings, reinforcing bars are used so as to improve strength. The reinforcing bars are bound with wires so that the reinforcing bars do not deviate from predetermined positions during concrete placement.

In the related art, suggested is a binding machine referred to as a reinforcing bar binding machine configured to wind a wire on two or more reinforcing bars and to twist the wire wound on the reinforcing bars, thereby binding the two or more reinforcing bars with the wire.

A technology where such a reinforcing bar binding machine is applied to an equipment instrument that is installed and used is suggested (for example, refer to JP2013-35052A).

SUMMARY

When applying a reinforcing bar binding machine to an equipment instrument that is installed and used, it is considered to increase an amount of the wire to be accommodated by making the reel on which the wire is wound larger than a reel of a size that can be loaded into the reinforcing bar binding machine of the related art.

However, when a reel made larger than a reel of a size that can be loaded into the reinforcing bar binding machine of the related art is used, a pull-out amount of wire may be insufficient in a wire feeding mechanism provided for the reinforcing bar binding machine. For this reason, when using a reel made larger than a reel of a size that can be loaded into the reinforcing bar binding machine of the related art, it is necessary to ensure that an amount of wire necessary for binding of reinforcing bars can be reliably pulled out.

The present invention has been made in view of the above situations, and an object thereof is to provide a binding device capable of enabling an amount of wire necessary for binding of a reinforcing bar to be reliably pulled out.

According to an aspect of the invention, a binding device includes a binding mechanism configured to feed a wire around a reinforcing bar, and to twist and bind the wire fed around the reinforcing bar, a binding mechanism moving part configured to move the binding mechanism between a binding position where binding of the reinforcing bar is performed and a retreat position distant from the reinforcing bar, and a wire pull-out part configured to pull out the wire wound on the reel. The wire pull-out part includes a transmission part to which an operation of the binding mechanism moving part is transmitted, and the transmission part is configured such that an amount of the wire pulled out by the wire pull-out part is different from an amount of movement of the binding mechanism moved by an operation of the binding mechanism moving part.

In the present invention, the amount of wire that is pulled out by the wire pull-out part is made different from the amount of movement of the binding mechanism in the operation of moving the binding mechanism between the binding position and the retreat position, and an amount of wire necessary for binding of the reinforcing bar is pulled out by the amount of movement of the binding mechanism.

According to another aspect of the invention, A binding device includes a binding mechanism configured to feed a wire around a reinforcing bar, and to twist and bind the wire fed around the reinforcing bar, a binding mechanism moving part configured to move the binding mechanism between a binding position where binding of the reinforcing bar is performed and a retreat position distant from the reinforcing bar, and a wire pull-out part configured to pull out the wire wound on the reel. The transmission part is configured such that an amount of the wire necessary for binding of the reinforcing bar is pulled out by the wire pull-out part by an amount of movement of the binding mechanism moved by an operation of the binding mechanism moving part.

In the present invention, the amount of wire necessary for binding of the reinforcing bar is pulled out by the operation of moving the binding mechanism between the binding position and the retreat position.

According to another aspect of the invention, a binding device includes a binding mechanism configured to feed a wire around a reinforcing bar, and to twist and bind the wire fed around the reinforcing bar, a binding mechanism moving part configured to move the binding mechanism between a binding position where binding of the reinforcing bar is performed and a retreat position distant from the reinforcing bar, and a wire pull-out part configured to pull out the wire wound on the reel. The controller is configured to pull out an amount of the wire necessary for binding of the reinforcing bar by the wire pull-out part in accordance with movement of the binding mechanism moved by the binding mechanism moving part.

In the present invention, the amount of wire necessary for binding of the reinforcing bar is pulled out by the wire pull-out part at the timing when the wire is used in the binding mechanism, in accordance with the movement of the binding mechanism made by the binding mechanism moving part.

According to the present invention, the amount of wire necessary for binding of the reinforcing bar can be pulled out with force of moving the binding mechanism. Thereby, it is possible to suppress a pull-out amount of the wire from becoming insufficient.

In addition, according to the present invention, the amount of wire necessary for binding of the reinforcing bar can be pulled out at the timing when the wire is used in the binding mechanism. Thereby, it is possible to suppress a pull-out amount of the wire from becoming insufficient.

DESCRIPTION OF EMBODIMENTS

Hereinafter, embodiments of the binding device for binding reinforcing bars with a wire will be described with reference to the drawings.

Overall Configuration Example of Binding Device of First Embodiment

Figure 1A:
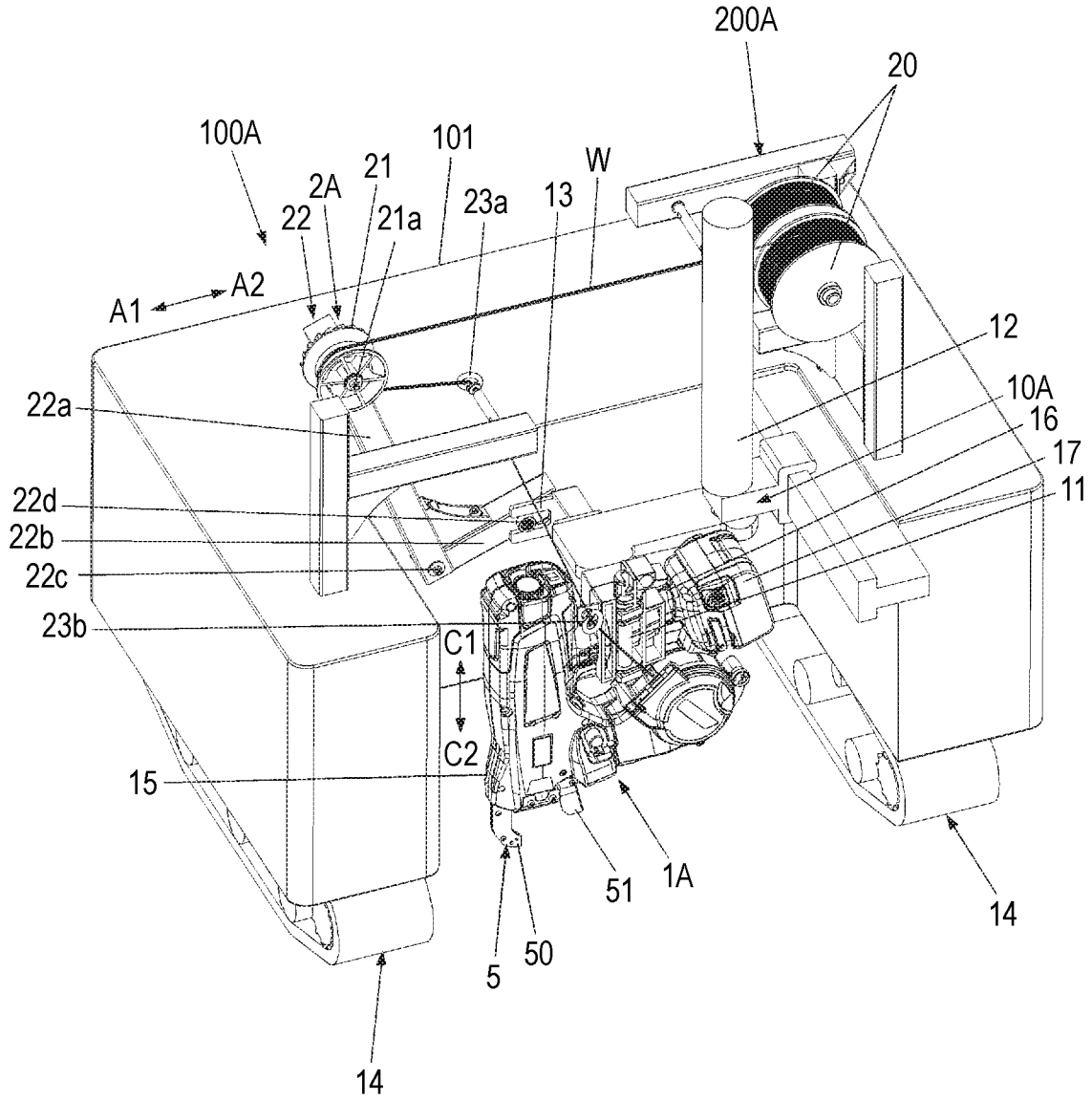
FIG. 1A is a perspective view showing an example of a binding device according to a first embodiment.
Figure 1B:
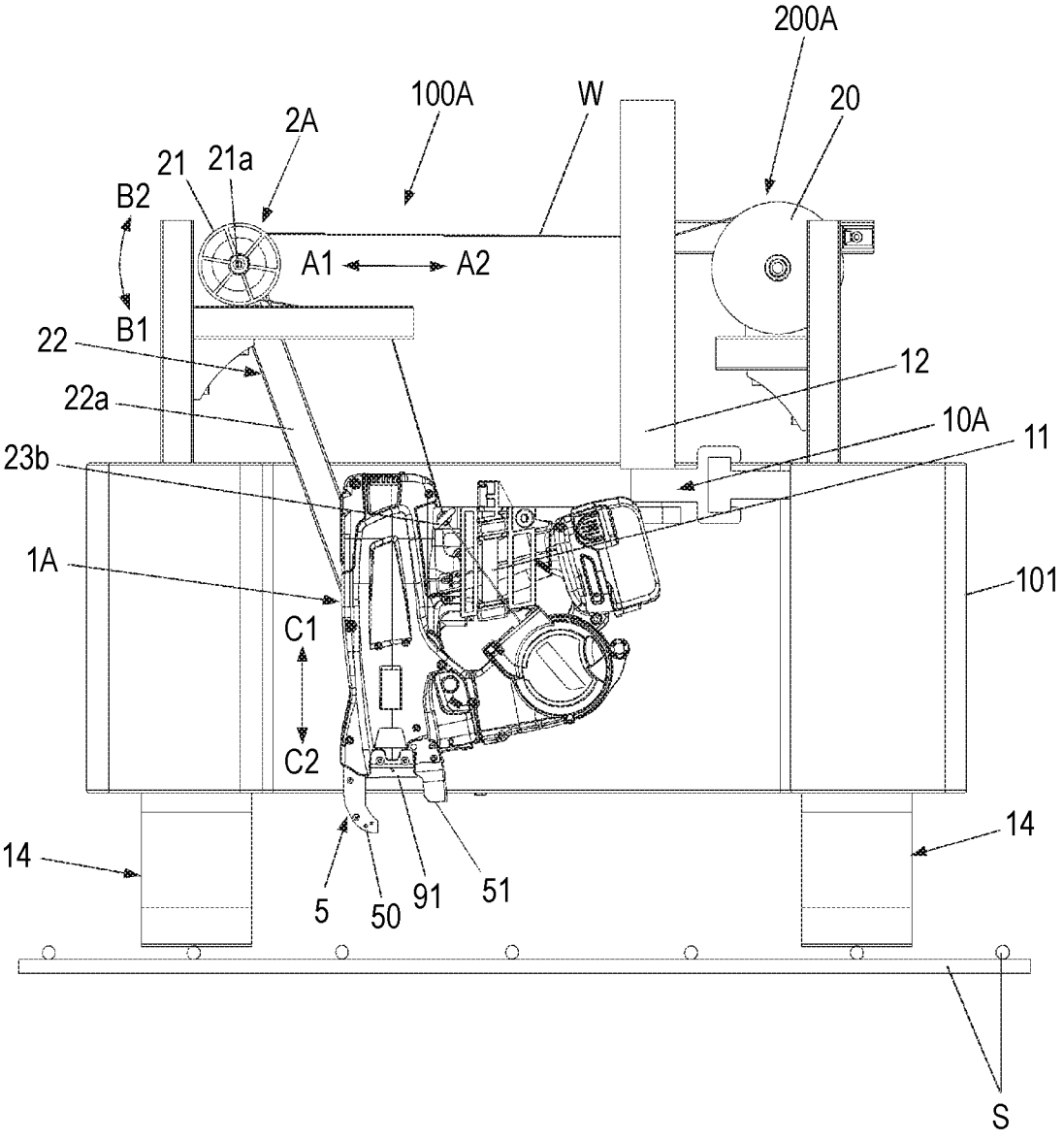
FIG. 1B is a front view showing the example of the binding device according to the first embodiment.
Figure 1C:
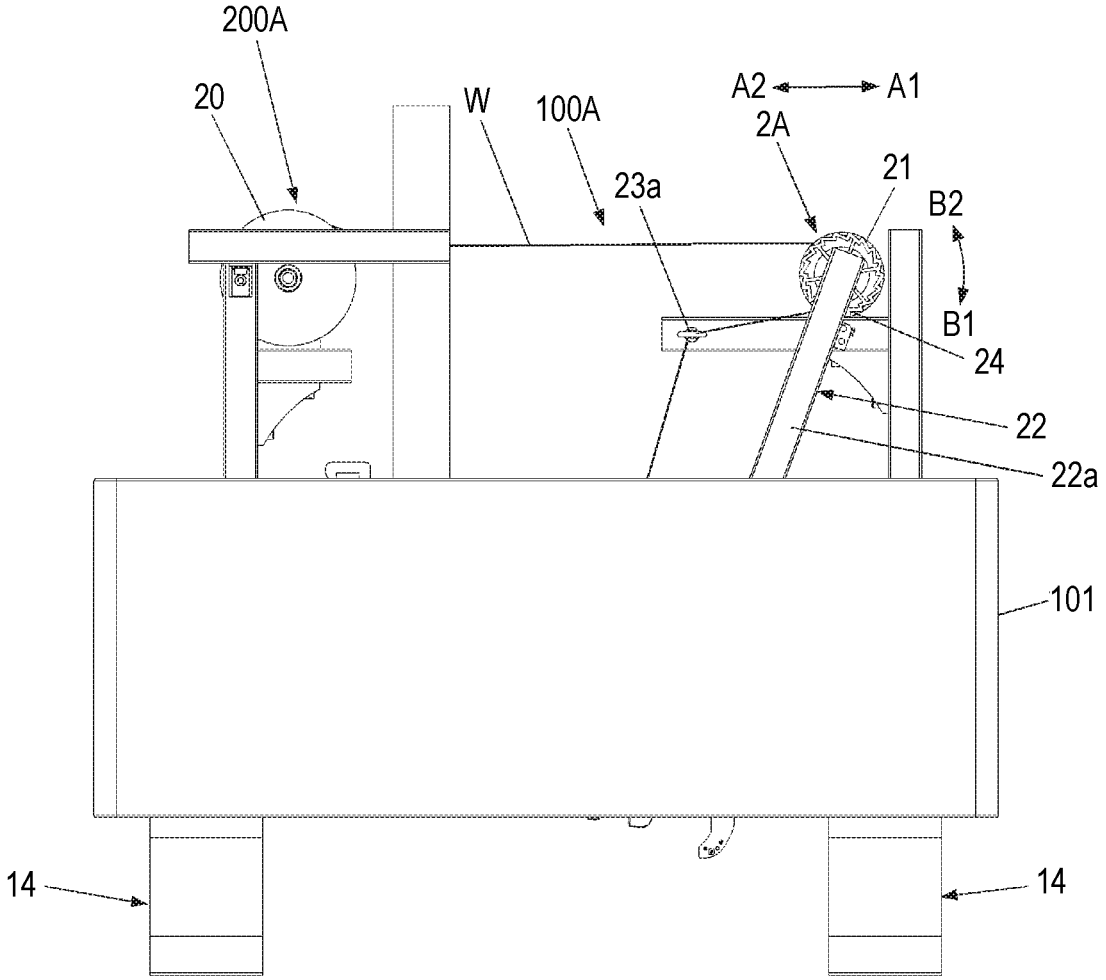
FIG. 1C is a rear view showing the example of the binding device according to the first embodiment.
Figure 1D:
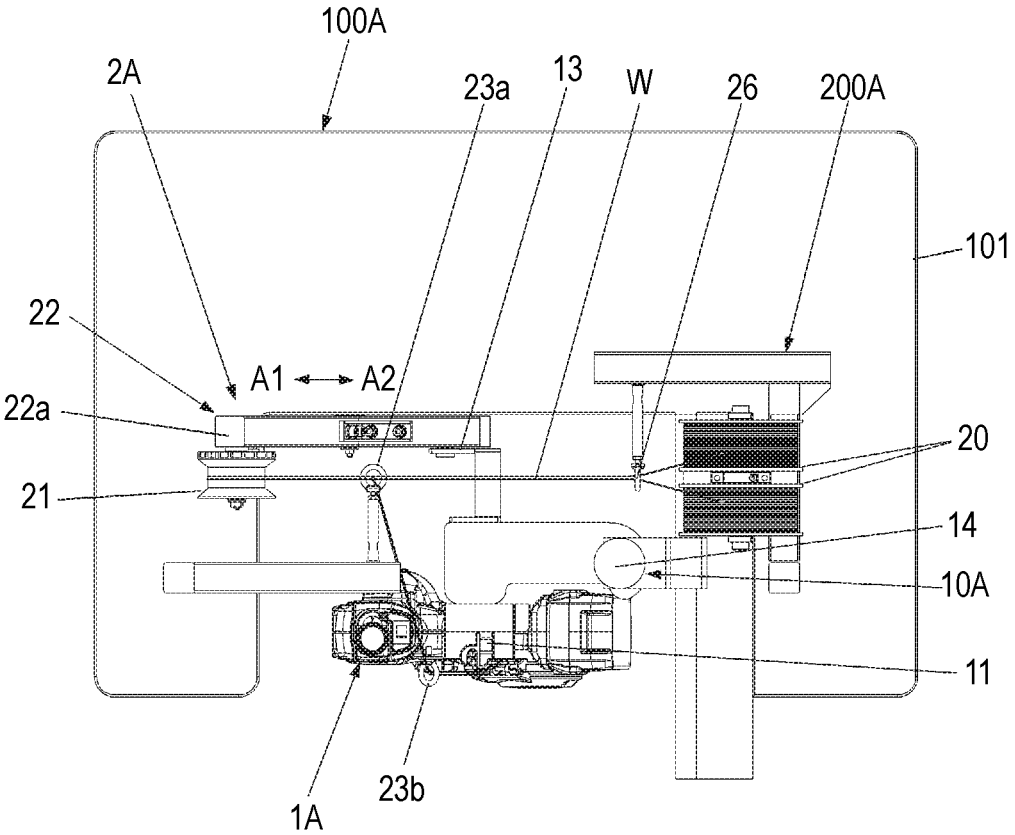
FIG. 1D is a top view showing the example of the binding device according to the first embodiment.
Figure 1E:
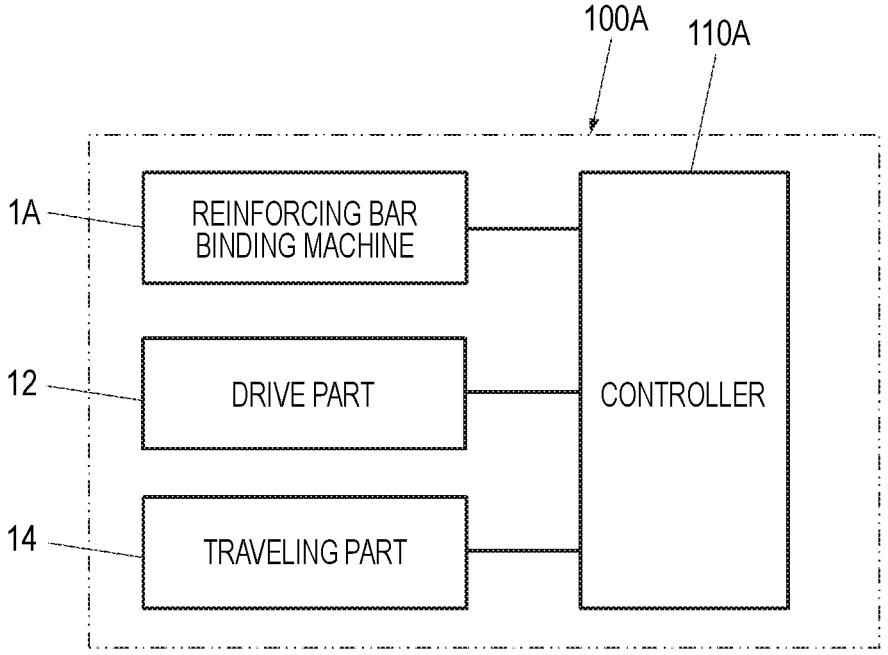
FIG. 1E is a functional block diagram showing the example of the binding device according to the first embodiment.

FIG. 1A is a perspective view showing an example of a binding device according to a first embodiment, FIG. 1B is a front view showing the example of the binding device according to the first embodiment, FIG. 1C is a rear view showing the example of the binding device according to the first embodiment, and FIG. 1D is a top view showing the example of the binding device according to the first embodiment. In addition, FIG. 1E is a functional block diagram showing the example of the binding device according to the first embodiment.

A binding device 100A according to the first embodiment includes a reinforcing bar binding machine 1A that binds intersections of reinforcing bars S arranged in a grid shape with a wire W, and a binding machine moving part 10A that moves the reinforcing bar binding machine 1A between a binding position and a retreat position in a substantially vertical direction intersecting an arrangement surface of the reinforcing bars S.

In addition, the binding device 100A includes a wire pull-out part 2A that pulls out the wire W from a reel 20 on which the wire W that is used in the reinforcing bar binding machine 1A is wound, and a reel accommodation part 200A in which the reel 20 is accommodated.

Additionally, the binding device 100A includes a traveling part 14 that moves the entire binding device 100A along the arrangement surface of the reinforcing bars S.

The binding device 100A has a configuration in which the traveling part 14 rides and moves on the reinforcing bars S arranged in a grid shape, and the arrangement surface of the reinforcing bars S becomes a substantially horizontal surface.

An outline of operations of the binding device 100A will be described. The binding device 100A moves with the traveling part 14 so that a position of the reinforcing bar binding machine 1A matches an intersection of the reinforcing bars S, which are an object to be bound, the binding machine moving part 10A moves the reinforcing bar binding machine 1A from a standby position to a binding position, and then the reinforcing bar binding machine 1A binds the reinforcing bars S with the wire W.

When the binding of the reinforcing bars S by the reinforcing bar binding machine 1A is completed, the binding machine moving part 10A moves the reinforcing bar binding machine 1A from the binding position to the standby position. Further, as the reinforcing bar binding machine 1A moves from the binding position to the standby position, the wire pull-out part 2A pulls out the wire W to be used in a next binding operation from the reel 20.

Next, the configuration of each part of the binding device 100A will be described. The binding machine moving part 10A is an example of the binding mechanism moving part, and includes a binding machine mounting part 11 to which the reinforcing bar binding machine 1A is mounted, a drive part 12 that moves the binding machine mounting part 11 in a vertical direction indicated by arrows C1 and C2, and a connecting portion 13 that connects to the wire pull-out part 2A. The drive part 12 includes a power source such as a motor and an actuator capable of controlling an amount of movement, a moving direction, a moving speed, and the like, and various mechanisms for converting movement (output) of the power source into movement in the directions of arrows C1 and C2 of the binding machine mounting part 11.

The binding machine moving part 10A moves the reinforcing bar binding machine 1A mounted to the binding machine mounting part 11 in an upward direction indicated by the arrow C1 by a predetermined amount, thereby moving the reinforcing bar binding machine 1A to the retreat position. In addition, the binding machine moving part 10A moves the reinforcing bar binding machine 1A mounted to the binding machine mounting part 11 in a downward direction indicated by the arrow C2 by a predetermined amount, thereby moving the reinforcing bar binding machine 1A from the retreat position to the binding position.

The wire pull-out part 2A includes a pull-out roller 21 provided on a feeding path of the wire W between the reinforcing bar binding machine 1A and the reel accommodation part 200A, a roller moving part 22 that moves the pull-out roller 21, and path induction members 23*a* and 23*b* that change a path along which the wire W is fed.

The pull-out roller 21 is an example of the pull-out member, is configured by a rotating body capable of rotating with a shaft 21*a* as a fulcrum, and has an outer circumferential surface that the wire W contacts.

The roller moving part 22 moves the pull-out roller 21 in a direction in which the wire W is pulled out from the reel 20 accommodated in the reel accommodating part 200A and in a direction of getting away from the pulled-out wire W. The roller moving part 22 reciprocally moves the pull-out roller 21 in a direction of an arrow A1, which is a direction in which the pull-out roller 21 becomes distant from the reel accommodation part 200A and the wire W is pulled out from the reel 20 accommodated in the reel accommodation part 200A, and in a direction of an arrow A2, which is a direction in which the pull-out roller 21 approaches the reel accommodation part 200A, in the present example. The directions of the arrows A1 and A2 are directions different from the direction in which the reinforcing bar binding machine 1A moves between the binding position and the retreat position, and the wire pull-out part 2A pulls out the wire W in a substantially horizontal direction approximately orthogonal to the moving direction of the reinforcing bar binding machine 1A, in the present example.

The roller moving part 22 constitutes a transmission part to which an operation of the binding machine moving part 10A is transmitted and which moves the pull-out roller 21 in conjunction with the movement of the reinforcing bar binding machine 1A. Therefore, the roller moving part 22 is provided with a first link 22*a* to which the pull-out roller 21 is attached, and a second link 22*b* connected to the reinforcing bar binding machine 1A via the binding machine moving part 10A. In the roller moving part 22, the first link 22*a* and the second link 22*b* are integrally connected in such a form that the first link 22*a* extends in one direction from a shaft 22*c* and the second link 22*b* extends in another direction from the shaft 22*c* so that the first link 22*a* and the second link 22*b* can interlock and rotate with the shaft 22*c* as a fulcrum.

In the roller moving part 22, the pull-out roller 21 is rotatably attached to an end portion of the first link 22*a* on an opposite side to the shaft 22*c*, with the shaft 21*a* as a fulcrum. In addition, the roller moving part 22 includes a connected portion 22*d* provided at an end portion of the second link 22*b* on an opposite side to the shaft 22*c* and connected to the binding machine moving part 10A. In the present example, the connected portion 22*d* is configured by a columnar or cylindrical convex portion protruding from the second link 22*b* along the extension direction of the shaft 22*c*.

The connecting portion 13 of the binding machine moving part 10A is opened with a width slightly larger than a diameter of the connected portion 22*d* of the roller moving part 22, and extends in a direction intersecting the moving direction of the reinforcing bar binding machine 1A.

In the binding device 100A, the connected portion 22*d* configured by the columnar or cylindrical convex portion enters the connecting portion 13 configured by a groove opened with a width slightly larger than a diameter of the connected portion 22*d*, so that the roller-moving part 22 and the reinforcing bar binding machine 1A are connected and the movement of the reinforcing bar binding machine 1A in the directions of the arrows C1 and C2 is transmitted to the roller moving part 22.

In the binding device 100A, the moving directions of the reinforcing bar binding machine 1A indicated by the arrows C1 and C2 and the pull-out direction of the wire W from the reel 20 indicated by the arrow A1 are substantially orthogonal to each other. Therefore, the roller moving part 22 converts the movement of the reinforcing bar binding machine 1A along the vertical direction indicated by the arrows C1 and C2 into the movement of the pull-out roller 21 along the horizontal direction indicated by the arrows A1 and A2.

To this end, in the present example, in the roller moving part 22, the first link 22*a* and the second link 22*b* are connected in an L shape, and the shaft 22*c* is provided at an intersection of the first link 22*a* and the second link 22*b*.

The first link 22*a* constitutes one side of the L-shaped member, intersects the moving direction of the pull-out roller 21 indicated by the arrows A1 and A2, and extends from the shaft 22*c* in one direction that is a direction along the moving directions of the reinforcing bar binding machine 1A indicated by the arrows C1 and C2. In addition, the second link 22*b* constitutes the other side of the L-shaped member, intersects the moving directions of the reinforcing bar binding machine 1A indicated by the arrows C1 and C2, and extends from the shaft 22*c* in the other direction that is a direction along the moving directions of the pull-out roller 21 indicated by the arrows A1 and A2.

Thereby, when the reinforcing bar binding machine 1A moves in the direction of the arrow C1, a side of the second link 22*b* on which the connected portion 22*d* is provided moves in the direction of the arrow C1, so that the roller moving part 22 rotates with the shaft 22*c* as a fulcrum and a side of the first link 22*a* on which the pull-out roller 21 is provided moves in the direction of the arrow A1. Thereby, when the reinforcing bar binding machine 1A moves in the direction of the arrow C1 from the binding position to the retreat position, the pull-out roller 21 moves in the direction of the arrow A1 in which it becomes distant from the reel accommodation part 200A and the wire W is pulled out from the reel 20 accommodated in the reel accommodation part 200A.

In addition, when the reinforcing bar binding machine 1A moves in the direction of the arrow C2, the side of the second link 22*b* on which the connected portion 22*d* is provided moves in the direction of the arrow C2, so that the roller moving part 22 rotates with the shaft 22*c* as a fulcrum and the side of the first link 22*a* on which the pull-out roller 21 is provided moves in the direction of the arrow A2. Thereby, when the reinforcing bar binding machine 1A moves in the direction of the arrow C2 from the retreat position to the binding position, the pull-out roller 21 moves in the direction of the arrow A2 in which it approaches the reel accommodation part 200A and becomes distant from the wire W pulled out from the reel 20. In other words, when the reinforcing bar binding machine 1A moves in the direction of the arrow C2 from the retract position to the binding position, the pull-out roller 21 moves in the direction of the arrow A2 and approaches the reel accommodation part 200A. As a result, the pull-out roller 21 becomes distant from a vertex of the wire W in the direction of the arrow A1.

In the roller moving part 22, the pull-out roller 21 moves with a rotation angle of the first link 22*a* and the second link 22*b* and a locus along a circular arc having a length corresponding to a diameter from the shaft 22*c* to the shaft 21*a* of the pull-out roller 21 by a rotating operation with the shaft 22*c* of the first link 22*a* and the second link 22*b* as a fulcrum.

In addition, in the roller moving part 22, the connected portion 22*d* moves with the rotation angle of the first link 22*a* and the second link 22*b* and the locus along the circular arc having a length corresponding to a diameter from the shaft 22*c* to the connected portion 22*d* by the rotating operation with the shaft 22*c* of the first link 22*a* and the second link 22*b* as a fulcrum.

The roller moving part 22 is configured such that a length from the shaft 22*c* to the shaft 21*a* of the pull-out roller 21 is longer than a length from the shaft 22*c* to the connected portion 22*d* so that a pull-out amount of the wire W by the movement of the pull-out roller 21 is n times (n>1) as large as an amount of movement of the reinforcing bar binding machine 1A connected to the connected portion 22*d*.

Thereby, the roller moving part 22 can move the pull-out roller 21 in the direction of the arrow A1 to pull out the wire W of a length exceeding an amount of movement of the reinforcing bar binding machine 1A from the reel 20 by a rotating operation with the shaft 22*c* of the first link 22*a* and the second link 22*b* as a fulcrum, which is made in conjunction with the movement in the direction of the arrow C1 of the reinforcing bar binding machine 1A.

Note that the roller moving part 22 may be configured such that the length from the shaft 22*c* to the shaft 21*a* of the pull-out roller 21 is the same as the length from the shaft 22*c* to the connected portion 22*d* so that a pull-out amount of the wire W by the movement of the pull-out roller 21 is the same as an amount of movement of the reinforcing bar binding machine 1A connected to the connected portion 22*d*. Further, in order to amplify the torque for moving the pull-out roller 21, the length from the shaft 22*c* to the shaft 21*a* of the pull-out roller 21 may be configured to be shorter than the length from the shaft 22*c* to the connected portion 22*d*.

The path induction member 23*a* is provided on the feeding path of the wire W between the pull-out roller 21 and the reinforcing bar binding machine 1A. The path induction member 23*b* is provided on the feeding path of the wire W between the path induction member 23*a* and the reinforcing bar binding machine 1A. The path induction members 23*a* and 23*b* are each configured by an annular member, and two wires W are caused to pass through central hole portions of the annular members, so that the feeding path of the wire W along the horizontal direction is bent into the feeding path of the wire W along the vertical direction.

In an operation of moving the pull-out roller 21 in the directions of the arrows A1 and A2, in an operation of binding the reinforcing bars S with the wire W by the reinforcing bar binding machine 1A, and in an operation of moving the reinforcing bar binding machine 1A in the directions of the arrows C1 and C2, an introduction direction of the wire W into the path induction members 23*a* and 23*b* is changed. However, since portions of the path induction members 23*a* and 23*b* that the wire W contacts are curved surfaces, an increase in resistance due to frictional movement is suppressed.

In order to reduce a load that is applied to the wire W between the reinforcing bar binding machine 1A and the pull-out roller 21 during an operation in which the pull-out roller 21 moves in the direction of the arrow A1 and pulls out the wire W, the wire pull-out part 2A may include a one-way rotation regulating mechanism (one-way clutch) 24 that allows rotation of the pull-out roller 21 in a direction indicated by an arrow B1 and regulates rotation in a direction indicated by an arrow B2.

The one-way rotation regulating mechanism 24 is realized by a ratchet structure, in the present example, and has a tooth portion formed along a circumferential direction of the pull-out roller 21, and a claw portion provided on the first link 22*a* side and configured to engage with the tooth portion as a result of being urged in a direction of engaging with the tooth portion. In the one-way rotation regulating mechanism 24, when force is applied to rotate the pull-out roller 21 in the direction of the arrow B1, the claw portion is detached from the tooth portion, and thus, the pull-out roller 21 can rotate in the direction of the arrow B1. In contrast, when force is applied to rotate the pull-out roller 21 in the direction of the arrow B2, the engagement of the claw portion and the tooth portion is maintained, and the rotation of the pull-out roller 21 in the direction of the arrow B2 is regulated.

In an operation in which the pull-out roller 21 moves in the direction of the arrow A1 and pulls out the wire W, relatively pulling force by the wire W between the pull-out roller 21 and the reinforcing bar binding machine 1A is applied to the pull-out roller 21. The rotating direction of the pull-out roller 21 indicated by the arrow B1 is a direction in which the pull-out roller 21 is intended to rotate as a result of relatively pulling force being applied to the pull-out roller 21 by the wire W between the pull-out roller 21 and the reinforcing bar binding machine 1A.

In contrast, in an operation in which the pull-out roller 21 moves in the direction of the arrow A1 and pulls out the wire W, relatively pulling force by the wire W between the pull-out roller 21 and the reel 20 is also applied to the pull-out roller 21. The rotating direction of the pull-out roller 21 indicated by the arrow B2 is a direction in which the pull-out roller 21 is intended to rotate as a result of relatively pulling force being applied to the pull-out roller 21 by the wire W between the pull-out roller 21 and the reel 20.

In an operation in which the pull-out roller 21 moves in the direction of the arrow A1 and pulls out the wire W, if the pull-out roller 21 does not rotate or rotates in the direction of the arrow B2, the load that is applied to the wire W between the reinforcing bar binding machine 1A and the pull-out roller 21 increases. When the load that is applied to the wire W between the reinforcing bar binding machine 1A and the pull-out roller 21 increases, the wire W between the reinforcing bar binding machine 1A and the pull-out roller 21 is subjected to pulling force from the reinforcing bar binding machine 1A due to the movement of the pull-out roller 21. For this reason, the wire W may come off from the reinforcing bar binding machine 1A.

In contrast, in an operation in which the pull-out roller 21 moves in the direction of the arrow A1 and pulls out the wire W, when the pull-out roller 21 rotates in the direction of the arrow B1, the load applied to the wire W between the reinforcing bar binding machine 1A and the pull-out roller 21 is reduced. When the load applied to the wire W between the reinforcing bar binding machine 1A and the pull-out roller 21 is reduced, the pulling force from the reinforcing bar binding machine 1A due to the movement of the pull-out roller 21 is suppressed from being applied to the wire W between the reinforcing bar binding machine 1A and the pull-out roller 21. For this reason, the wire W is suppressed from coming off from the reinforcing bar binding machine 1A.

In addition, in an operation in which the pull-out roller 21 moves in the direction of the arrow A1 and pulls out the wire W, when the pull-out roller 21 rotates in the direction of the arrow B1, the load applied to the wire W between the reel 20 and the pull-out roller 21 increases. When the load applied to the wire W between the reel 20 and the pull-out roller 21 increases, the wire W between the reel 20 and the pull-out roller 21 is subjected to pulling force from the reel 20 by the movement of the pull-out roller 21. Thereby, a sufficient amount of the wire W is pulled out from the reel 20 following the amount of movement of the pull-out roller 21 in the direction of the arrow A1.

The binding device 100A is provided at one side of a rectangular main body part 101 with a concave part having a shape into which parts or all of the reinforcing bar binding machine 1A, the binding machine moving part 10A and the wire pull-out part 2A are introduced. In addition, the binding device 100A has the traveling part 14 provided on a lower surface of the main body part 101. The traveling part 14 includes an endless track that is driven by a motor (not shown). In the binding device 100A, the endless track constituting the traveling part 14 rides on the reinforcing bars S arranged in a grid shape, and the endless track rotates to move along the arrangement surface of the reinforcing bars S.

Further, the binding device 100A has the reel accommodation part 200A provided on an upper surface of the main body part 101. In the reel accommodation part 200A, in the case of a configuration in which the reinforcing bar binding machine 1A binds the reinforcing bars S with the two wires W, the two reels 20 are aligned along the axial directions and rotatably accommodated coaxially with axes of rotation being transverse orientations to the vertical direction. In addition, the reel accommodation part 200A includes a path induction member 26 that guides the two wires W pulled out from the respective reels 20 to the pull-out roller 21 in a parallel form.

The path induction member 26 is provided on the feeding path of the wire W between the reel accommodating part 200A and the pull-out roller 21. The path induction member 26 is configured by an annular member, and two wires W are caused to pass through a central hole portion of the annular member.

In the reel 20, the wire W is wound by overlapping in a radial direction while changing its position along an axial direction of a hub (not shown) of the reel 20. For this reason, in an operation of pulling out the wire W from the reel 20, a position where the wire W is pulled out changes along the axial direction of the reel 20. In addition, the position where the wire W is pulled out changes along the radial direction of the reel 20, according to an amount of the wire W used. Thereby, in the operation of pulling out the wire W from the reel 20, an introduction direction of the wire W to the path induction member 26 is changed. However, since a portion of the path induction member 26 that the wire W contacts is a curved surface, an increase in resistance due to frictional movement is suppressed.

In the binding device 100A, the drive part 12 of the binding machine moving part the traveling part 14, and the reinforcing bar binding machine 1A are controlled by a controller 110A. In the binding device 100A, the operation of moving the reinforcing bar binding machine 1A by the binding machine moving part 10A is transmitted to the roller moving part 22, and the pull-out roller 21 pulls out the wire W by the operation of the roller moving part 22 in accordance with the movement of the reinforcing bar binding machine 1A. To this end, the controller 110A controls the wire pull-out part 2A by controlling the drive part 12 of the binding machine moving part 10A.

Configuration Example of Reinforcing Bar Binding Machine

Figure 2:
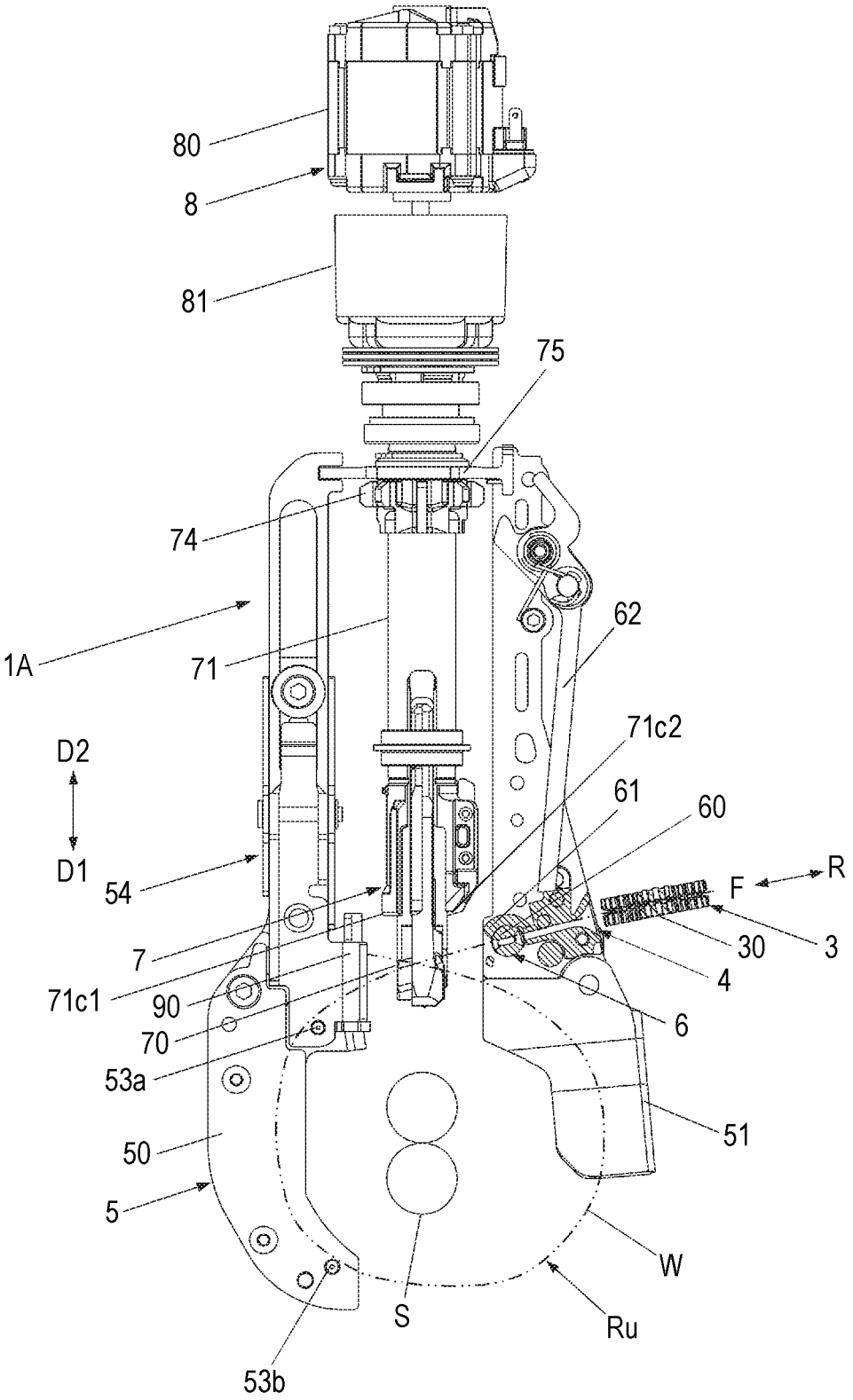
FIG. 2 is a side view of main parts showing an example of an internal configuration of a reinforcing bar binding machine according to the present embodiment.

FIG. 2 is a side view of main parts showing an example of an internal configuration of the reinforcing bar binding machine according to the present embodiment.

The reinforcing bar binding machine 1A is an example of the binding mechanism, and feeds a wire W in a forward direction denoted with an arrow F, winds the wire around two intersecting reinforcing bars S, which are an object to be bound, feeds the wire W wound around the reinforcing bars S in a reverse direction denoted with an arrow R, winds the wire on the reinforcing bars S, and twists the wire W, thereby binding the reinforcing bars S with the wire W. For the wire W, a wire made of a plastically deformable metal wire, a wire having a metal wire covered with a resin, or a twisted wire is used.

In order to implement the functions described above, the reinforcing bar binding machine 1A includes a wire feeding part 3 that feeds the wire W in the forward direction and the reverse direction, and a wire guide 4 that guides the wire W fed by the wire feeding part 3. In addition, the reinforcing bar binding machine 1A includes a curl forming part 5 that forms a path along which the wire W fed by the wire feeding part 3 is to be wound around the reinforcing bars S, and a cutting part 6 that cuts the wire W wound on the reinforcing bars S. In addition, the reinforcing bar binding machine 1A includes a binding part 7 that twists the wire W wound on the reinforcing bars S, and a drive part 8 that drives the binding part 7.

In the reinforcing bar binding machine 1A, the wire feeding part 3, the wire guide 4, the cutting part 6, the binding part 7, and the drive part 8 are provided inside a main body part covered with an exterior having a predetermined shape. In addition, the curl forming part 5 is provided protruding from the main body part 15. When the reinforcing bar binding machine 1A is used for the binding device 100A, it is used in such a form that the curl forming part 5 faces downward. Hereinafter, in the reinforcing bar binding machine 1A used for the binding device 100A, a side on which the curl forming part 5 is provided is set as a lower side.

The wire feeding part 3 includes a pair of feeding gears 30 that sandwiches and feeds one or a plurality of wires W aligned in parallel. In the wire feeding part 3A, the pair of feeding gears 30 is urged toward each other, and a rotating operation of a feeding motor (not shown) is transmitted to rotate the feeding gears 30. Thereby, the wire feeding part 3 feeds the wire W sandwiched between the pair of feeding gears 30 along an extension direction of the wire W. In a configuration where a plurality of, for example, two wires W are fed, the two wires W are fed aligned in parallel.

The wire guide 4 is provided at a predetermined position on each of an upstream side and a downstream side of the wire feeding part 3 with respect to a forward feeding direction of the wire W denoted with an arrow F. Note that, in FIG. 2, the wire guide 4 provided on the upstream side of the wire feeding part 3 is not shown.

The wire guide 4 is provided with an opening extending along the feeding direction of the wire W, and an opening area of the opening on the downstream side is configured to be smaller, as compared with the opening on the upstream side along the forward feeding direction of the wire W. For example, the wire guide 4 is configured to have a tapered opening whose opening area is largest on an introduction-side of the wire W, which is fed in the forward direction, and is gradually reduced from the introduction-side. Thereby, the wire guide 4 guides the wire W fed in the forward direction and passing through the wire guide 4 toward a space between the pair of feeding gears 30 and toward the cutting part 6.

In a configuration in which the reinforcing bar binding machine 1A binds the reinforcing bars S with two wires W, the wire guide 4 has a shape in which the opening on the downstream side along the forward feeding direction of the wires W regulates an orientation in a radial direction of the two wires W. Thereby, the wire guide 4 arranges the two wires W fed in the forward direction and passing through the wire guide 4 in parallel along a direction in which the pair of feeding gears 30 is aligned, and guides the two wires toward a space between the pair of feeding gears 30 and toward the cut part 6.

The curl forming part 5 includes a curl guide 50 that curls the wire W fed by the wire feeding part 3, and an induction guide 51 that guides the wire W curled by the curl guide toward the binding part 7. In the curl forming part 5, the curl guide 50 and the induction guide 51 are provided exposed from the main body part 10.

In the reinforcing bar binding machine 1A, the feeding path of the wire W that is fed by the wire feeding part 3 is regulated by the curl forming part 5, so that a locus of the wire W becomes a loop Ru as shown with a broken line in FIG. 2 and the wire W is thus wound around the reinforcing bars S.

The curl forming part 5 has guide members 53*a* and 53*b* that guide the wire W fed in the forward direction and curl the wire W. The guide member 53*a* is provided on a side of the curl guide 50 on which the wire W fed by the wire feeding part 3 is introduced, and is arranged on a radially inner side of the loop Ru that is formed by the wire W fed by the wire feeding part 3. The guide member 53*b* is provided on a side of the curl guide 50 on which the wire W fed by the wire feeding part 3 is discharged, and is arranged on a radially outer side of the loop Ru that is formed by the wire W.

The curl forming part 5 includes a guide member moving mechanism 54 that retreats the guide member 53*a*. The guide member moving mechanism 54 retreats the guide member 53*a* in conjunction with an operation of the binding part 7 after the wire W is wound around the reinforcing bars S.

The cutting part 6 includes a fixed blade part 60, a movable blade part 61 that cuts the wire W by cooperating with the fixed blade part 60, and a transmission mechanism 62 that transmits an operation of the binding part 7 to the movable blade part 61. The cutting part 6 cuts the wire W by a rotating operation of the movable blade part 61 about the fixed blade part as a fulcrum shaft. The transmission mechanism 62 transmits an operation of the binding part 7 to the movable blade part 61 via a transmission member 75 and rotates the movable blade part 61 in conjunction with the operation of the binding part 7, thereby cutting the wire W.

The binding part 7 includes a wire locking body 70 to which the wire W is locked, and a sleeve 71 for actuating the wire locking body 70. A detailed configuration of the binding part 7 will be described later. The drive part 8 includes a motor 80, and a decelerator 81 that performs deceleration and amplification of torque.

In a case where the reinforcing bar binding machine 1A has a form that an operator grips and uses with a hand, a handle part 16 is provided on the main body part 15, and a battery 17 is detachably mounted to the handle part 16. In the binding device 100A, the handle part 16 of the reinforcing bar binding machine 1A is mounted to the binding machine mounting part 11 of the binding machine moving part 10A.

The reinforcing bar binding machine 1A includes a feeding regulation part 90 against which a tip end of the wire W is butted, on the feeding path of the wire W that is fed in the forward direction by the wire feeding part 3 and passes through the curl forming part 5 to be wound around the reinforcing bars S.

In addition, the reinforcing bar binding machine 1A includes a butting portion 91 against which the reinforcing bars S inserted between the curl guide 50 and the induction guide 51 are butted, at an end portion of the main body part 15 between the curl guide 50 and the induction guide 51 (refer to FIG. 1B).

When the reinforcing bar binding machine 1A mounted to the binding device 100A is moved to the binding position by the operation of the binding machine moving part 10A, the reinforcing bars S are inserted between the curl guide 50 and the induction guide 51, and the reinforcing bars S inserted between the curl guide 50 and the induction guide 51 are butted against the butting portion 91.

Configuration Example of Binding Part

Figure 3A:
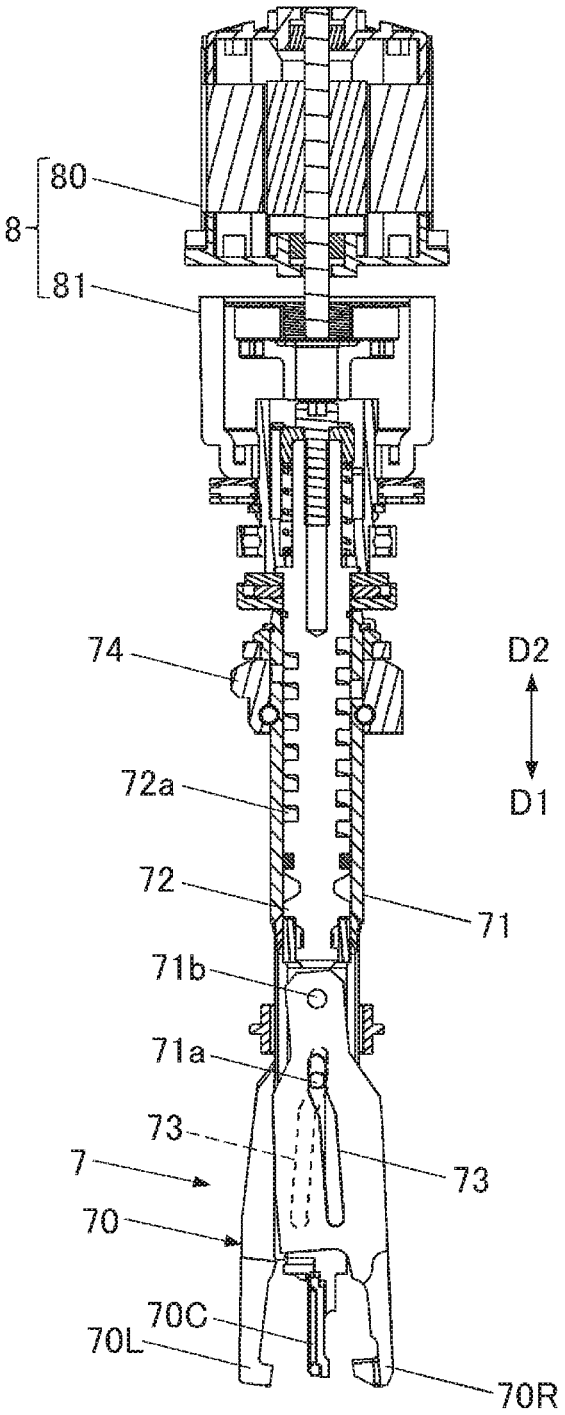
FIG. 3A is a sectional plan view showing an example of a binding part.
Figure 3B:
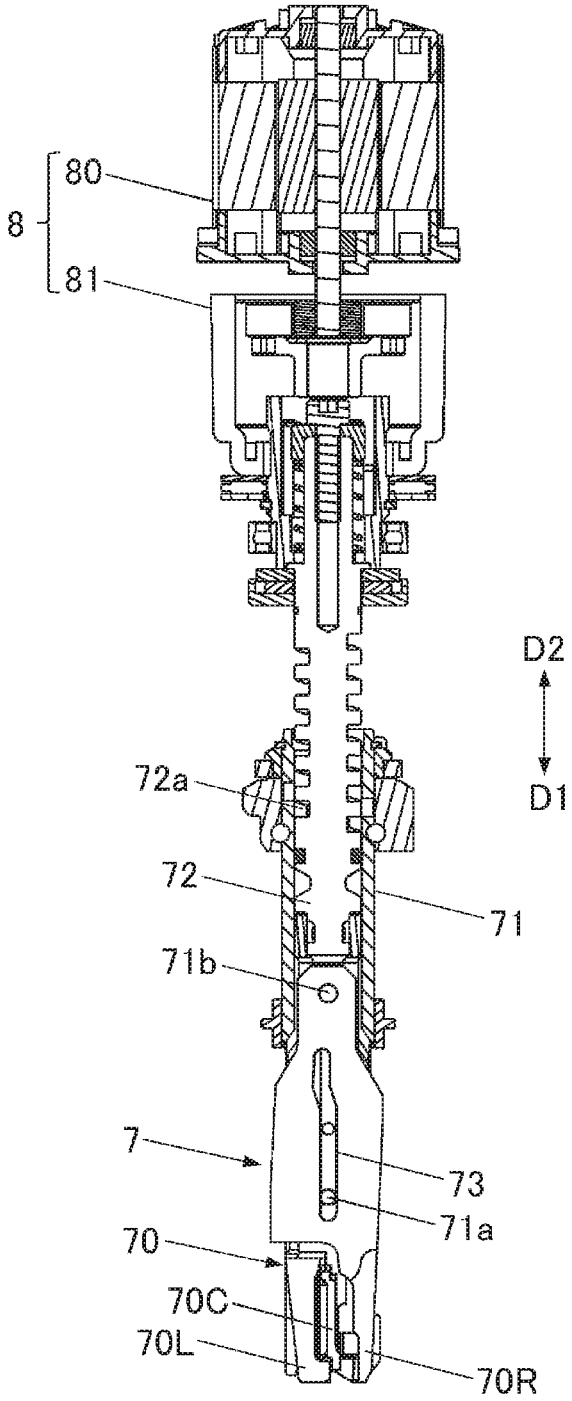
FIG. 3B is a sectional plan view showing the example of the binding part.

FIGS. 3A and 3B are sectional plan views showing an example of the binding part. Next, a configuration of the binding part will be described with reference to each drawing.

The binding part 7 includes a rotating shaft 72 that actuates the wire locking body 70 and the sleeve 71. The binding part 7 and the drive part 8 are configured such that the rotating shaft 72 and the motor 80 are connected via the decelerator 81 and the rotating shaft 72 is driven by the motor 80 via the decelerator 81.

The wire locking body 70 includes a center hook 70C connected to the rotating shaft 72, and a first side hook 70R and a second side hook 70L that open/close with respect to the center hook 70C.

The center hook 70C is connected to a tip end of the rotating shaft 72, which is one end portion along an axial direction of the rotating shaft 72, via a configuration that can rotate with respect to the rotating shaft 72 and move integrally with the rotating shaft 72 in the axial direction.

The wire locking body 70 opens/closes in directions in which the tip end-side of the first side hook 70R contacts/separates with respect to the center hook 70C by a rotating operation about a shaft 71*b* as a fulcrum. The wire locking body also opens/closes in directions in which the tip end side of the second side hook 70L contacts/separates with respect to the center hook 70C.

The sleeve 71 has a convex portion (not shown) protruding from an inner circumferential surface of a space in which the rotating shaft 72 is inserted, and the convex portion enters a groove portion of a feeding screw 72*a* formed along the axial direction on an outer circumference of the rotating shaft 72. When the rotating shaft 72 rotates, the sleeve 71 moves in the upper and lower direction, which is a direction along the axial direction of the rotating shaft 72, according to a rotation direction of the rotating shaft 72 by an action of the convex portion (not shown) and the feeding screw 72*a* of the rotating shaft 72. The sleeve 71 also rotates integrally with the rotating shaft 72.

The sleeve 71 has an opening/closing pin 71*a* that opens/closes the first side hook and the second side hook 70L.

The opening/closing pin 71*a* is inserted into opening/closing guide holes 73 formed in the first side hook 70R and the second side hook 70L. The opening/closing guide hole 73 has a shape of extending along a moving direction of the sleeve 71 and converting a linear motion of the opening/closing pin 71*a* that moves in conjunction with the sleeve 71 into an opening/closing operation by rotation of the first side hook 70R and the second side hook 70L about the shaft 71*b* as a fulcrum.

The wire locking body 70 is configured such that, when the sleeve 71 is moved in an upward direction denoted with an arrow D2, the first side hook 70R and the second side hook 70L move away from the center hook 70C by the rotating operation about the shaft 71*b* as a fulcrum, due to a locus of the opening/closing pin 71*a* and the shape of the opening/closing guide holes 73.

Thereby, the first side hook 70R and the second side hook 70L are opened with respect to the center hook 70C, so that a feeding path through which the wire W passes is formed between the first side hook 70R and the center hook 70C and between the second side hook 70L and the center hook 70C.

In a state where the first side hook 70R and the second side hook 70L are opened with respect to the center hook 70C, the wire W that is fed by the wire feeding part 3 passes between the center hook 70C and the first side hook 70R. The wire W passing between the center hook 70C and the first side hook 70R is guided to the curl forming part 5. Then, the wire W curled by the curl forming part 5 and guided to the binding part 7 passes between the center hook 70C and the second side hook 70L.

The wire locking body 70 is configured such that, when the sleeve 71 is moved in a downward direction denoted with an arrow D1, the first side hook 70R and the second side hook 70L move toward the center hook 70C by the rotating operation about the shaft 71*b* as a fulcrum, due to the locus of the opening/closing pin 71*a* and the shape of the opening/closing guide holes 73. Thereby, the first side hook 70R and the second side hook 70L are closed with respect to the center hook 70C.

When the first side hook 70R is closed with respect to the center hook 70C, the wire W sandwiched between the first side hook 70R and the center hook 70C is locked in such an aspect that the wire can move between the first side hook 70R and the center hook 70C. In addition, when the second side hook 70L is closed with respect to the center hook 70C, the wire W sandwiched between the second side hook 70L and the center hook 70C is locked in such an aspect that the wire cannot come off between the second side hook 70L and the center hook 70C.

The sleeve 71 has a bending portion 71*c*1 that presses and bends a tip end side (one end portion) of the wire W in a predetermined direction to form the wire W into a predetermined shape, and a bending portion 71*c*2 that presses and bends a terminal end side (other end portion) of the wire W cut by the cutting part 6 the wire W a predetermined direction to form the wire W into a predetermined shape.

The sleeve 71 is moved in the downward direction denoted with the arrow D1, so that the tip end side of the wire W locked by the center hook 70C and the second side hook 70L is pushed and bent toward the reinforcing bars S by the bending portion 71*c*1. In addition, the sleeve 71 is moved in the downward direction denoted with the arrow D1, so that the terminal end side of the wire W locked by the center hook 70C and the first side hook 70R and cut by the cutting part 6 is pushed and bent toward the reinforcing bars S by the bending portion 71*c*2.

The binding part 7 includes a rotation regulation part 74 that regulates rotations of the wire locking body 70 and the sleeve 71 that are rotated in conjunction with the rotating operation of the rotating shaft 72. In the binding part 7, the rotation regulation part 74 regulates rotation of the sleeve 71 that is rotated in conjunction with rotation of the rotating shaft 72, according to a position of the sleeve 71 along an axial position of the rotating shaft 72, so that the sleeve 71 is moved in the direction of the arrow D1 and the direction of the arrow D2 by the rotating operation of the rotating shaft 72.

Thereby, the sleeve 71 moves in the direction of the arrow D1 without rotating, so that the first side hook 70R and the second side hook 70L are closed with respect to the center hook 70C, and the wire W is locked. In addition, the sleeve 71 moves in the direction of the arrow D2 without rotating, so that the first side hook 70R and the second side hook 70L are opened with respect to the center hook 70C, and the locking of the wire W is released.

The binding part 7 is configured such that when the rotation regulation on the sleeve 71 by the rotation regulation part 74 is released, the sleeve 71 is rotated in conjunction with the rotation of the rotating shaft 72.

Thereby, the first side hook 70R and second side hook 70L and the center hook 70C locking the wire W are rotated to twist the locked wire W.

Operation Example of Binding Device of First Embodiment

Figure 4A:
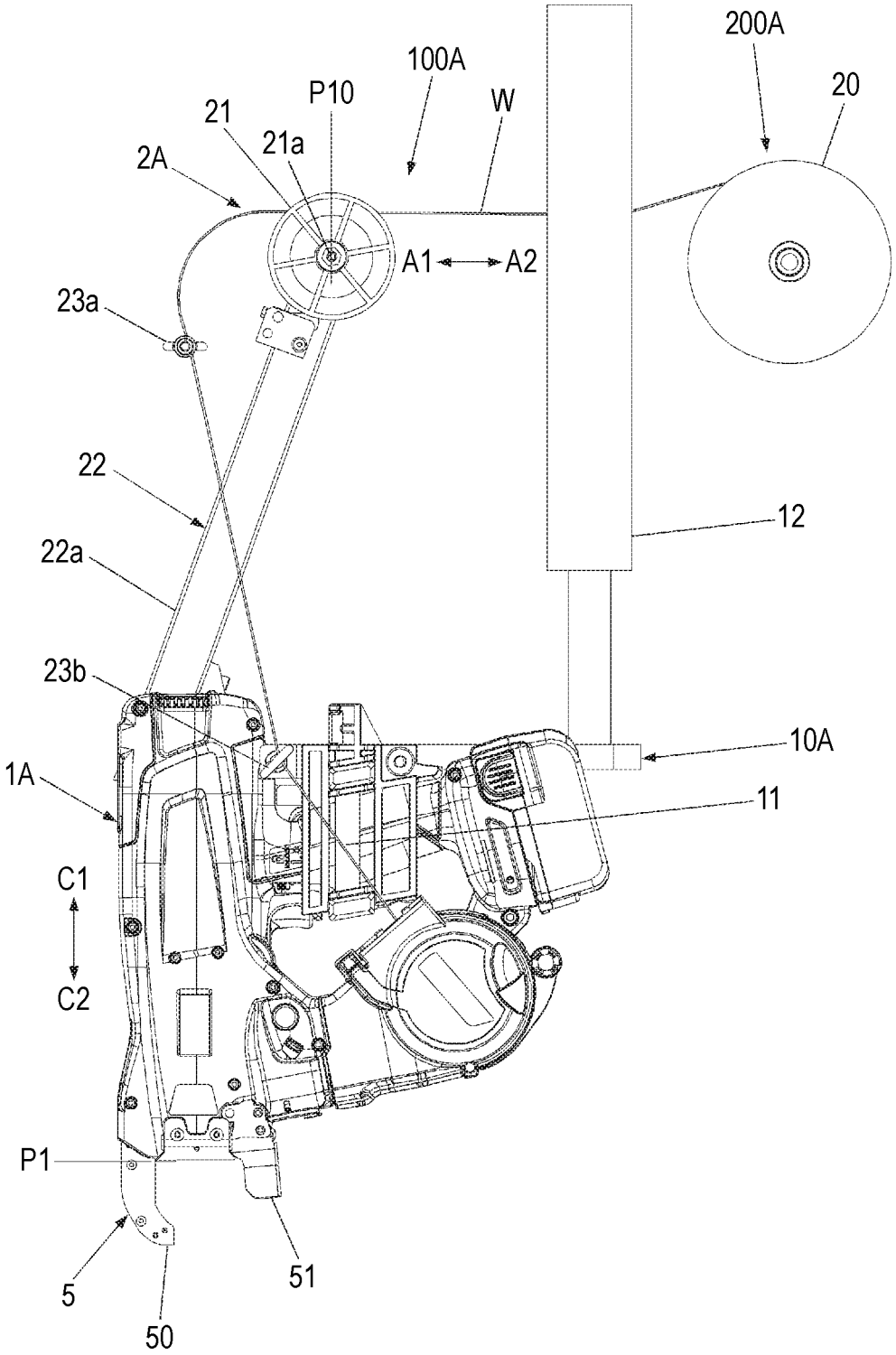
FIG. 4A is a front view of main parts showing an example of an operation of the binding device according to the first embodiment.
Figure 4B:
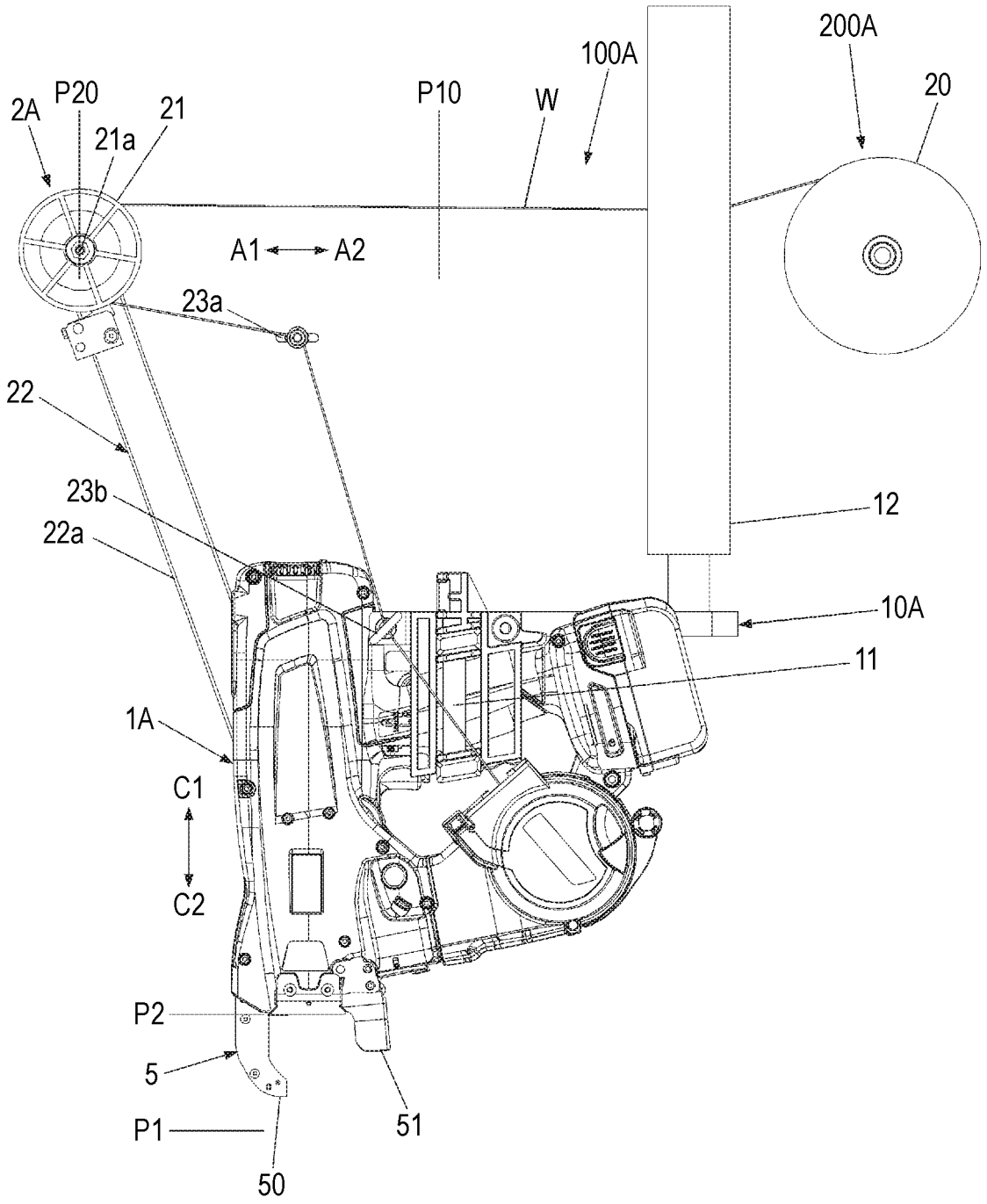
FIG. 4B is a front view of main parts showing the example of the operation of the binding device according to the first embodiment.
Figure 4C:
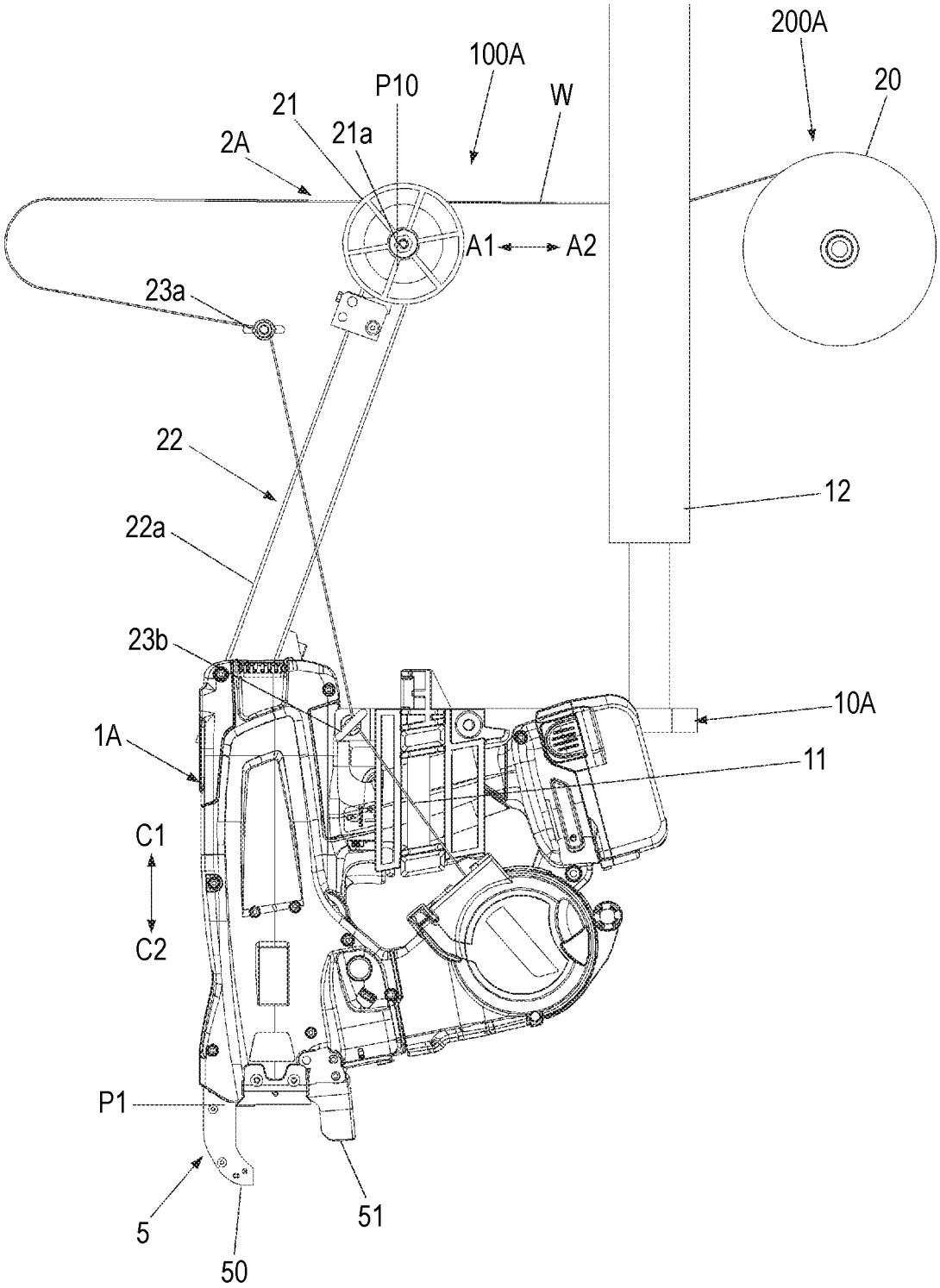
FIG. 4C is a front view of main parts showing the example of the operation of the binding device according to the first embodiment.

FIGS. 4A, 4B and 4C are front views of main parts showing an example of the operation of the binding device of the first embodiment. Referring to each drawing, an example of the operation of the binding device 100A in which the wire W is pulled out from the reel 20 and the wire W is made usable in the reinforcing bar binding machine 1A will be described.

In the binding device 100A, in a process where the reinforcing bar binding machine 1A is performing the binding operation, the reinforcing bar binding machine 1A is moved to the binding position P1, as shown in FIG. 4A. When the reinforcing bar binding machine 1A moves in the direction of the arrow C2 from the retreat position P2 shown in FIG. 4B to the binding position P1 shown in FIG. 4A, the roller moving part 22 moves in the direction of the arrow A2 on the side of the first link 22*a* on which the pull-out roller 21 is provided.

Thereby, when the reinforcing bar binding machine 1A moves in the direction of the arrow C2 from the retreat position P2 to the binding position P1, the pull-out roller 21 moves in the direction of the arrow A2 in which it approaches the reel accommodation part 200A and becomes distant from the wire W pulled out from the reel 20. Then, when the reinforcing bar binding machine 1A is moved to the binding position P1, the pull-out roller 21 is in a state of being moved to the standby position P10 distant from the wire W pulled out from the reel 20. In other words, when the reinforcing bar binding machine 1A moves in the direction of the arrow C2 from the retract position to the binding position, the pull-out roller 21 moves in the direction of the arrow A2 and approaches the reel accommodation part 200A. As a result, the pull-out roller 21 becomes distant from a vertex of the wire W in the direction of the arrow A1.

Note that, for the binding device 100A, a relationship between a use amount of the wire W in the binding operation and a pull-out amount of the wire W described later is set so that the pull-out roller 21 moved to the standby position P10 is in a state of being distant from the wire W pulled out from the reel 20 in a state in which the binding operation by the reinforcing bar binding machine 1A is completed.

In the binding device 100A, when the binding operation by the reinforcing bar binding machine 1A is completed, the controller 110A controls the drive part 12 of the binding machine moving part 10A to move the reinforcing bar binding machine 1A in the direction of the arrow C1 from the binding position P1 to the retreat position P2. In the roller moving part 22, the side of the first link 22*a* on which the pull-out roller 21 is provided moves in the direction of the arrow A1 when the reinforcing bar binding machine 1A moves in the direction of the arrow C1.

Thereby, when the reinforcing bar binding machine 1A moves in the direction of the arrow C1 from the binding position P1 to the retreat position P2, as shown in FIG. 4B, the pull-out roller 21 moves in the direction of the arrow A1 in which it becomes distant from the reel accommodation part 200A and the wire W is pulled out from the reel 20 accommodated in the reel accommodation part 200A. Then, when the reinforcing bar binding machine 1A moves to the retreat position P2, the pull-out roller 21 is in a state of being moved to the pull-out position P20 where the wire W is pulled out from the reel 20.

Note that, for the roller moving part 22, a length from the shaft 22*c* to the shaft 21*a* of the pull-out roller 21 and a length from the shaft 22*c* to the connected portion 22*d* may be set so that a pull-out amount of the wire W by the movement of the pull-out roller 21 is predetermined n times (n>1) as large as an amount of movement of the reinforcing bar binding machine 1A.

Thereby, the pull-out amount of the wire W by the movement of the pull-out roller 21 from the standby position P10 to the pull-out position P20 can be set to be predetermined n times, for example, about 3 times as large as the amount of movement of the reinforcing bar binding machine 1A from the binding position P1 to the retreat position P2, so that an amount of the wire W necessary for a next binding operation can be pulled out from the reel 20. With this pulling operation for the wire W, it is not necessary to match the amount of movement of the reinforcing bar binding machine 1A in accordance with the pull-out amount of the wire W necessary for the next binding operation, making it possible to reduce the amount of movement of the reinforcing bar binding machine 1A and to miniaturize the binding device 100A.

When the next binding operation starts after the pull-out operation for the wire W performed in conjunction with the movement of the reinforcing bar binding machine 1A is finished, the binding device 100A first moves the reinforcing bar binding machine 1A in the direction of the arrow C2 from the retreat position P2 to the binding position P1. In the roller moving part 22, the side of the first link 22*a* on which the pull-out roller 21 is provided moves in the direction of the arrow A2 when the reinforcing bar binding machine 1A moves in the direction of the arrow C2.

Thereby, when the reinforcing bar binding machine 1A moves in the direction of the arrow C2 from the retreat position P2 to the binding position P1, as shown in FIG. 4C, the pull-out roller 21 moves in the direction of the arrow A2 in which it approaches the reel accommodation part 200A and becomes distant from the wire W pulled out from the reel 20. Then, when the reinforcing bar binding machine 1A moves to the binding position, the pull-out roller 21 is in a state of being moved to the standby position P10 distant from the wire W pulled out from the reel 20. In other words, when the reinforcing bar binding machine 1A moves in the direction of the arrow C2 from the retract position to the binding position, as shown in FIG. 4C, the pull-out roller 21 moves in the direction of the arrow A2 and approaches the reel accommodation part 200A. As a result, the pull-out roller 21 becomes distant from a vertex of the wire W in the direction of the arrow A1.

When the reinforcing bar binding machine 1A moves to the binding position P1, the wire W pulled out from the reel 20 becomes loose between the reinforcing bar binding machine 1A and the reel 20. Thereby, in the operation of feeding the wire W by the wire feeding part 3 of the reinforcing bar binding machine 1A, a load for rotating the reel 20 and a load for rotating the pull-out roller 21 are not applied to the wire feeding part 3.

Note that, as described above, the reinforcing bar binding machine 1A feeds the wire W in the forward direction by the wire feeding part 3, winds the wire around two intersecting reinforcing bars S, feeds the wire W wound around the reinforcing bars S in the reverse direction by the wire feeding part 3, winds the wire on the reinforcing bars S, and twists the wire W, thereby binding the reinforcing bars S with the wire W. For this reason, in the operation of feeding the wire Win the forward direction by the wire feeding part 3, a pull-out amount of the wire W from the reel 20 is set by making the wire W have such a surplus that the wire does not come into contact with the pull-out roller 21 moved to the standby position P10.

In the binding device 100A, it is considered to increase an amount of the wire W to be accommodated by making the reel 20 on which the wire W is wound larger than a reel of a size that can be loaded into the reinforcing bar binding machine 1A of the related art.

In the operation of feeding the wire W in the forward direction by the wire feeding part 3, when the wire W comes into contact with the pull-out roller 21 moved to the standby position P10, the surplus of the wire W between the reinforcing bar binding machine 1A and the reel 20 is exhausted, and thereafter, it is necessary to feed the wire W in the forward direction by the wire feeding part 3 of the reinforcing bar binding machine 1A. However, when using the reel 20 larger than a reel of a size that can be loaded into the reinforcing bar binding machine 1A of the related art, the wire W cannot be sufficiently pulled out by the wire feeding part 3 of the reinforcing bar binding machine 1A, and therefore, the pull-out amount may become insufficient.

In contrast, the wire pull-out part 2A of the binding device 100A has a configuration in which the pull-out roller 21 is moved to pull out the wire W by using the force that moves the reinforcing bar binding machine 1A, and therefore, the force that pulls out the wire W is stronger, as compared with the wire feeding part 3 of the reinforcing bar binding machine 1A. Thereby, even when the reel 20 larger than a reel of a size that can be loaded into the reinforcing bar binding machine 1A of the related art is used, the amount of the wire W necessary for binding of the reinforcing bars S can be reliably pulled out.

In the operation of feeding the wire Win the forward direction by the wire feeding part 3, a pull-out amount of the wire W from the reel 20 is set by making the wire W have such a surplus that the wire does not come into contact with the pull-out roller 21 moved to the standby position P10. Thereby, it is not necessary to pull out the wire W from the reel 20 by the wire feeding part 3 of the reinforcing bar binding machine 1A, and therefore, the pull-out amount of the wire W is suppressed from becoming insufficient.

Therefore, an amount of the wire W necessary for winding around the two intersecting reinforcing bars S can be reliably fed by the wire feeding part 3. In addition, in the operation of feeding the wire W wound around the reinforcing bars S in the reverse direction indicated by the arrow R and winding the wire on the reinforcing bars S, the length of the wire W is suppressed from being insufficient, and therefore, the wire W can be reliably wound on the reinforcing bars S. Then, by reliably winding the wire W on the reinforcing bars S, the binding strength can be improved in the operation of twisting the wire W to bind the reinforcing bars S with the wire W.

Note that, in the binding device 100A, the controller 110A can detect the load applied to the drive part 12 at the time of moving the pull-out roller 21 to pull out the wire W. Therefore, when the load upon pulling out the wire W is higher than a specified value, the controller 110A determines that a sufficient amount of the wire W cannot be pulled out from the reel 20, and may stop the movement of the reinforcing bar binding machine 1A that is performed by the drive part 12 and notify an alarm, in the course of moving the reinforcing bar binding machine 1A from the binding position P1 to the retreat position P2.

In addition, when the remaining amount of the wire W wound on the reel 20 decreases, the load at the time of pulling out the wire W decreases, as compared with the case where the remaining amount of the wire W wound on the reel 20 is large. Therefore, the controller 110A may calculate the remaining amount of the wire W wound on the reel 20, based on the load applied to the drive part 12.

Overall Configuration Example of Binding Device of Second Embodiment

Figure 5A:
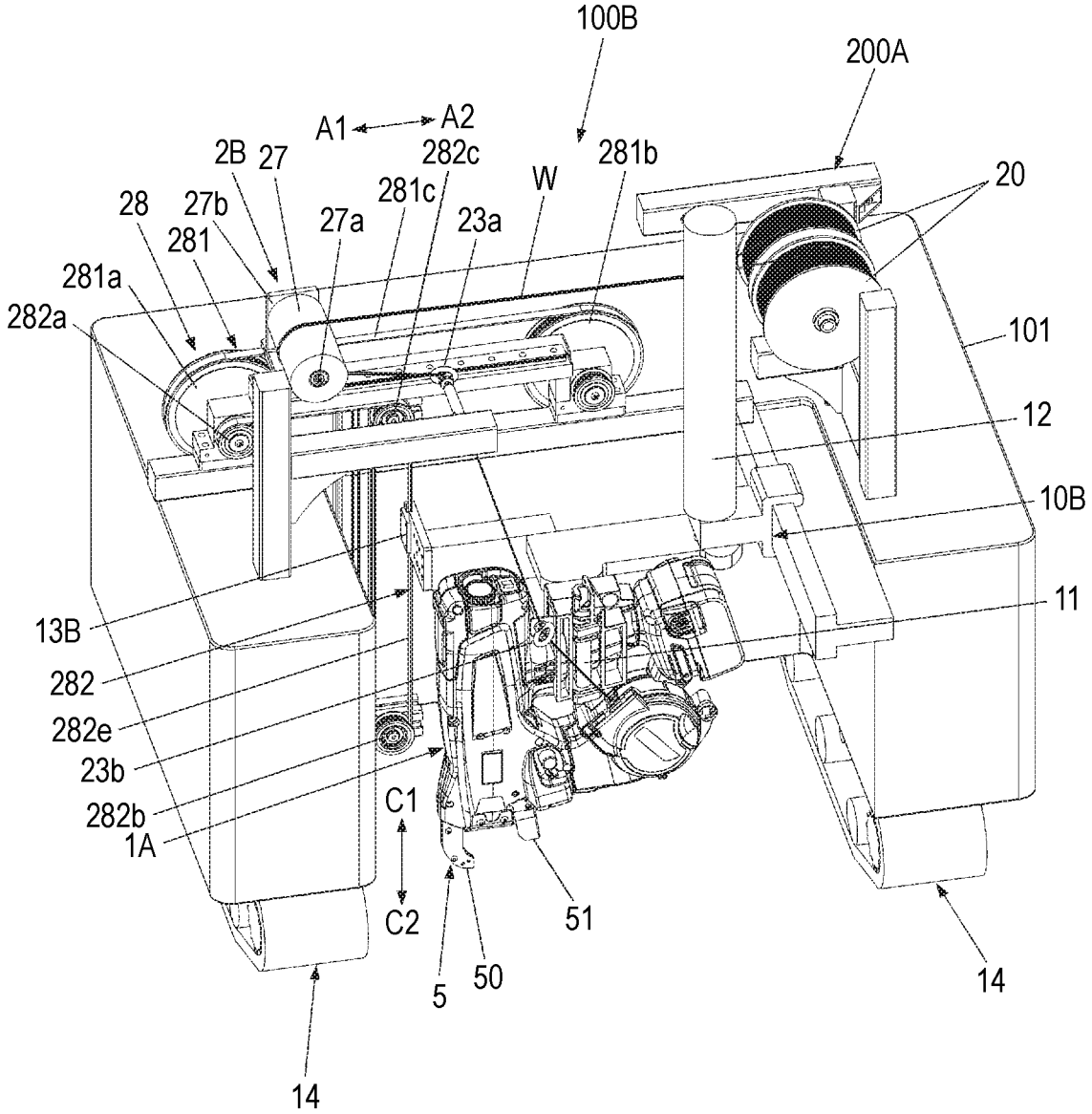
FIG. 5A is a perspective view showing an example of a binding device according to a second embodiment.
Figure 5B:
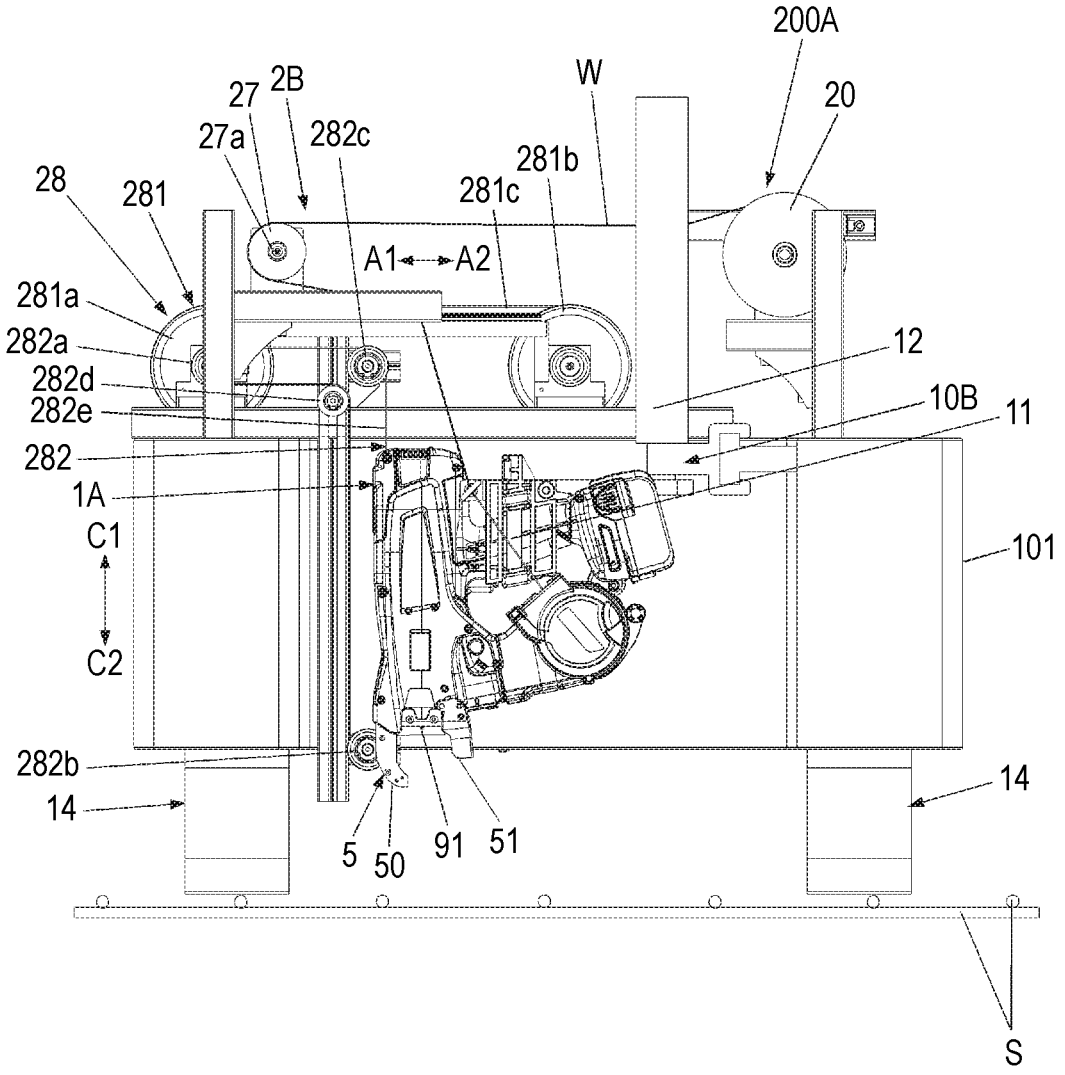
FIG. 5B is a front view showing the example of the binding device according to the second embodiment.
Figure 5C:
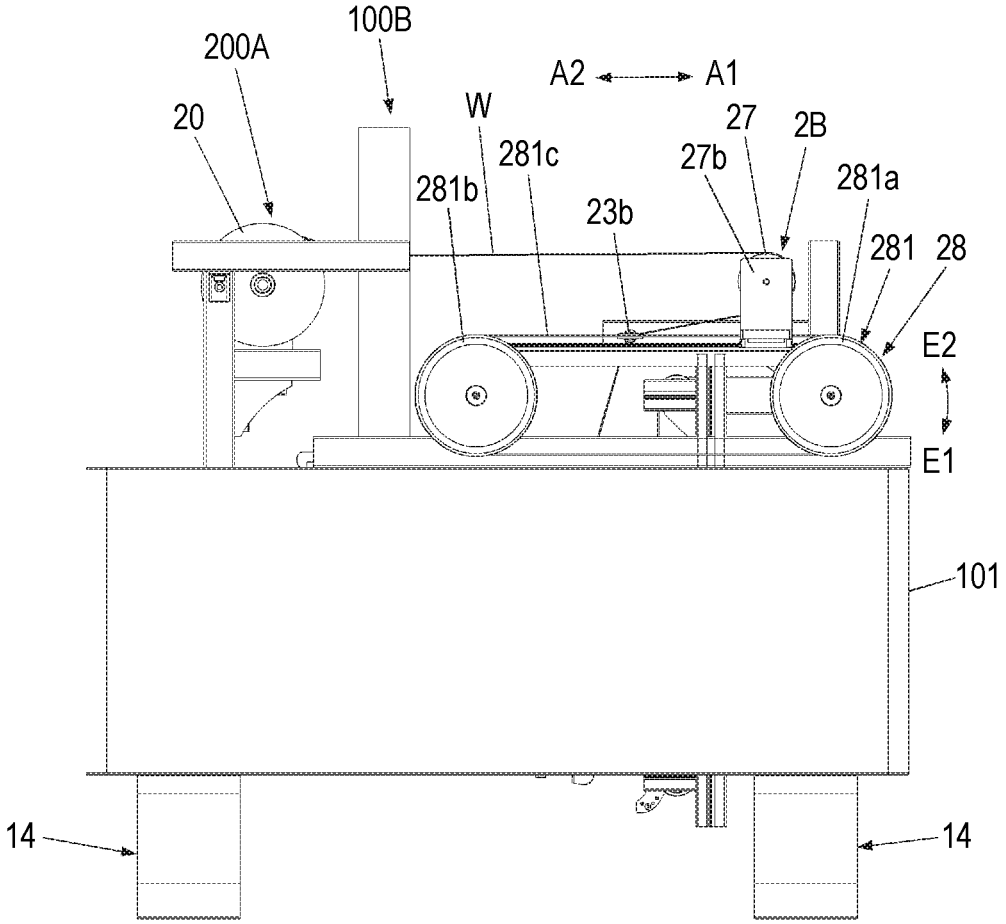
FIG. 5C is a rear view showing the example of the binding device according to the second embodiment.
Figure 5D:
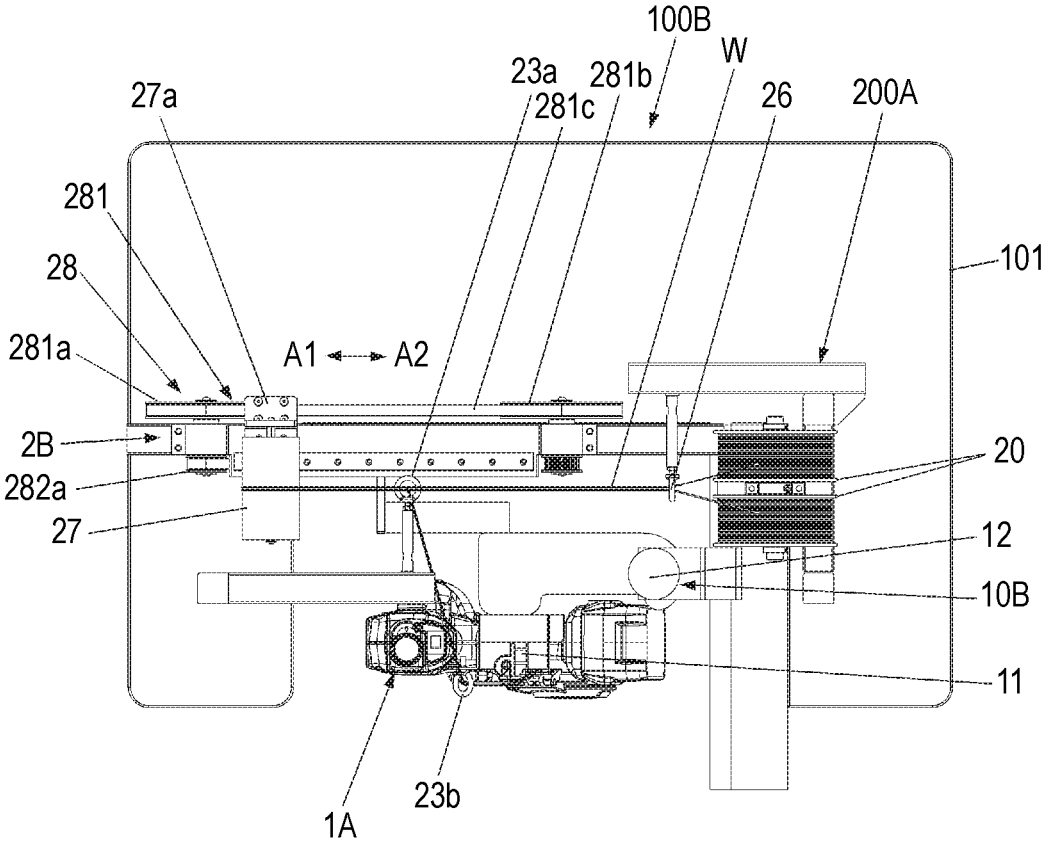
FIG. 5D is a top view showing the example of the binding device according to the second embodiment.
Figure 5E:
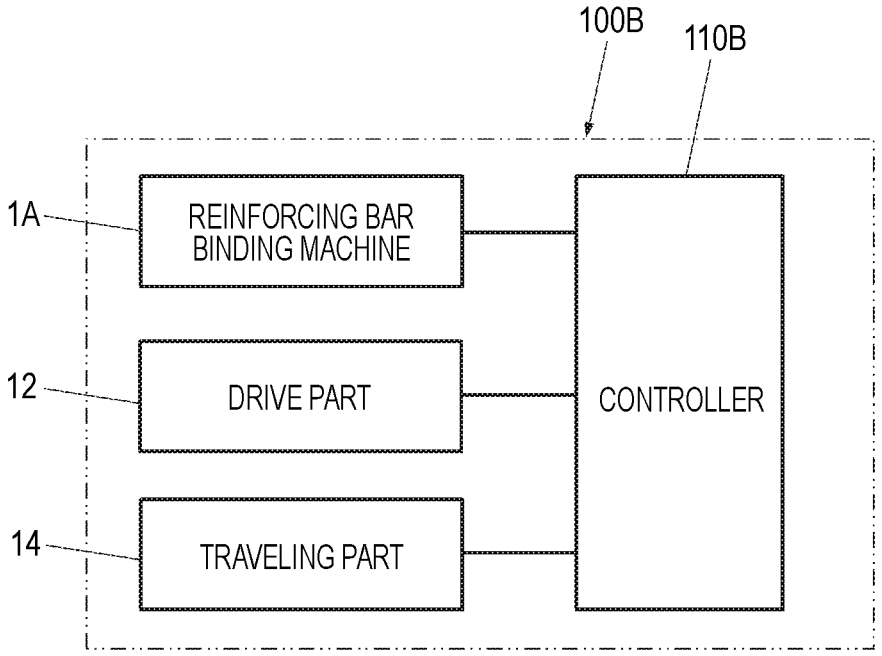
FIG. 5E is a functional block diagram showing the example of the binding device according to the second embodiment.

FIG. 5A is a perspective view showing an example of a binding device according to a second embodiment, FIG. 5B is a front view showing the example of the binding device according to the second embodiment, FIG. 5C is a rear view showing the example of the binding device according to the second embodiment, and FIG. 5D is a top view showing the example of the binding device according to the second embodiment. In addition, FIG. 5E is a functional block diagram showing the example of the binding device according to the second embodiment.

A binding device 100B of the second embodiment includes a reinforcing bar binding machine 1A that binds intersections of reinforcing bars S arranged in a grid shape with a wire W, and a binding machine moving part 10B that moves the reinforcing bar binding machine 1A between a binding position and a retreat position.

In addition, the binding device 100B includes a wire pull-out part 2B that pulls out the wire W from a reel 20 on which the wire W that is used in the reinforcing bar binding machine 1A is wound, and a reel accommodation part 200A in which the reel 20 is accommodated.

Additionally, the binding device 100B includes a traveling part 14 that moves the entire binding device 100B along the arrangement surface of the reinforcing bars S.

The binding machine moving part 10B is an example of the binding mechanism moving part, and includes a binding machine mounting part 11 to which the reinforcing bar binding machine 1A is mounted, a drive part 12 that moves the binding machine mounting part 11 in a vertical direction indicated by arrows C1 and C2, and a connecting portion 13B that connects to the wire pull-out part 2B. The drive part 12 includes a power source such as a motor and an actuator capable of controlling an amount of movement, a moving direction, a moving speed, and the like, and various mechanisms for converting movement (output) of the power source into movement in the directions of arrows C1 and C2 of the binding machine mounting part 11.

The binding machine moving part 10B moves the reinforcing bar binding machine 1A mounted to the binding machine mounting part 11 in an upward direction indicated by the arrow C1 by a predetermined amount, thereby moving the reinforcing bar binding machine 1A to the retreat position. In addition, the binding machine moving part 10B moves the reinforcing bar binding machine 1A mounted to the binding machine mounting part 11 in a downward direction indicated by the arrow C2 by a predetermined amount, thereby moving the reinforcing bar binding machine 1A from the retreat position to the binding position.

The wire pull-out part 2B includes a pull-out roller 27 provided on a feeding path of the wire W between the reinforcing bar binding machine 1A and the reel accommodation part 200A, a roller moving part 28 that moves the pull-out roller 27, and path induction members 23*a* and 23*b* that change a path along which the wire W is fed.

The pull-out roller 27 is an example of the pull-out member, is configured by a rotating body capable of rotating with a shaft 27*a* as a fulcrum, and has an outer circumferential surface that the wire W contacts.

The roller moving part 28 moves the pull-out roller 27 in a direction in which the wire W is pulled out from the reel 20 accommodated in the reel accommodating part 200A and in a direction of getting away from the pulled-out wire W. The roller moving part 28 reciprocally moves the pull-out roller 27 in a direction of an arrow A1, which is a direction in which the pull-out roller 27 becomes distant from the reel accommodation part 200A and the wire W is pulled out from the reel 20 accommodated in the reel accommodation part 200A, and in a direction of an arrow A2, which is a direction in which the pull-out roller 27 approaches the reel accommodation part 200A, in the present example.

The roller moving part 28 constitutes a transmission part to which an operation of the binding machine moving part 10B is transmitted and which moves the pull-out roller 27 in conjunction with the movement of the reinforcing bar binding machine 1A. Therefore, the roller moving part 28 is provided with a first belt part 281 connected to the pull-out roller 27, and a second belt part 282 connected to the reinforcing bar binding machine 1A via the binding machine moving part 10B.

The first belt part 281 includes a pair of rotatable pulleys 281*a* and 281*b* and a first belt 281*c* spanned between the pair of pulleys 281*a* and 281*b*. In the first belt part 281, the pulley 281*a* is provided on one side along the directions of arrows A1 and A2, the pulley 281*b* is provided on the other side, and the first belt 281*c* is spanned in a direction in which it can travel along the directions of the arrows A1 and A2.

The second belt part 282 includes four rotatable pulleys 282*a*, 282*b*, 282*c*, and 282*d* and a second belt 282*e* spanned among the four pulleys 282*a*, 282*b*, 282*c*, and 282*d*.

In the second belt part 282, the pulley 282*a* is provided on one side along the directions of the arrows A1 and A2, and the pulley 282*b* is provided on a lower side that is one side along the directions of the arrows C1 and C2. Additionally, in the second belt part 282, the pulley 282*c* is provided on an upper side that is the other side along the directions of the arrows A1 and A2 and is the other side along the directions of the arrows C1 and C2, and the pulley 282*d* is provided facing the pulley 282*c*.

Further, in the second belt part 282, the second belt 282*e* is spanned in a direction in which it can travel along the directions of the arrows C1 and C2 between the pulleys 282*b* and 282*c*, and in a direction in which it can travel along the directions of the arrows A1 and A2 between the pulleys 282*a* and 282*c*.

In the roller moving part 28, the pulley 281*a* of the first belt part 281 and the pulley 282*a* of the second belt part 282 are provided coaxially, and the pulley 281*a* rotates in synchronization with the rotation of the pulley 282*a*.

In the roller moving part 28, a support portion 27*b* of the pull-out roller 27 is connected to a portion of the first belt 281*c* of the first belt part 281, which travels in the directions of the arrows A1 and A2. In addition, in the roller moving part 28, a connecting portion 13B of the binding machine moving part 10B is connected to a portion of the second belt 282*e* of the second belt part 282, which travels in the directions of the arrows C1 and C2.

Thereby, in the binding device 100B, when the binding machine moving part 10B moves the reinforcing bar binding machine 1A in the direction of the arrow C1, the portion of the second belt 282*e* of the second belt part 282, to which the binding machine mounting part 11 is connected, travels in the direction of the arrow C1, each pulley on which the second belt 282*e* is spanned rotates, and the pulley 282*a* of the second belt part 282 rotates in a direction of an arrow E1.

When the pulley 282*a* of the second belt part 282 rotates in the direction of the arrow E1, the pulley 281*a* of the first belt part 281 rotates in the direction of the arrow E1. When the pulley 281*a* of the first belt part 281 rotates in the direction of the arrow E1, the portion of the first belt 281*c* of the first belt part 281, to which the pull-out roller 27 is connected, travels in the direction of the arrow A1.

Therefore, when the reinforcing bar binding machine 1A moves in the direction of the arrow C1 from the binding position to the retreat position, the binding device 100B moves from the standby position to the pull-out position, in the direction of the arrow A1 in which the pull-out roller 27 becomes distant from the reel accommodation part 200A and the wire W is pulled out from the reel 20 accommodated in the reel accommodation part 200A.

In addition, in the binding device 100B, when the binding machine moving part 10B moves the reinforcing bar binding machine 1A in the direction of the arrow C2, the portion of the second belt 282*e* of the second belt part 282, to which the binding machine mounting part 11 is connected, travels in the direction of the arrow C2, each pulley on which the second belt 282*e* is spanned rotates, and the pulley 282*a* of the second belt part 282 rotates in a direction of an arrow E2.

When the pulley 282*a* of the second belt part 282 rotates in the direction of the arrow E2, the pulley 281*a* of the first belt part 281 rotates in the direction of the arrow E2. When the pulley 281*a* of the first belt part 281 rotates in the direction of the arrow E2, the portion of the first belt 281*c* of the first belt part 281, to which the pull-out roller 27 is connected, travels in the direction of the arrow A2.

Therefore, in the binding device 100B, when the reinforcing bar binding machine 1A moves in the direction of the arrow C2 from the retreat position to the binding position, the pull-out roller 27 approaches the reel accommodation part 200A and moves from the pull-out position to the standby position, in the direction of the arrow A2 in which the pull-out roller 27 becomes distant from the wire W pulled out from the reel 20. In other words, when the reinforcing bar binding machine 1A moves in the direction of the arrow C2 from the retract position to the binding position, the pull-out roller 27 moves in the direction of the arrow A2 and approaches the reel accommodation part 200A.

The roller moving part 28 is configured such that a diameter of the pulley 281*a* of the first belt part 281 that rotates in synchronization with the pulley 282*a* and moves the pull-out roller 27 is larger than that of the pulley 282*a* of the second belt part 282 that rotates with the movement of the reinforcing bar binding machine 1A so that a pull-out amount of the wire W by the movement of the pull-out roller 21 is n times (n>1) as large as an amount of movement of the reinforcing bar binding machine 1A.

Thereby, the roller moving part 28 can move the pull-out roller 27 in the direction of the arrow A1 to pull out the wire W of a length exceeding an amount of movement of the reinforcing bar binding machine 1A from the reel 20 by a rotating operation of the pulley 281*a* that is rotated in conjunction with the movement in the direction of the arrow C1 of the reinforcing bar binding machine 1A.

Note that the roller moving part 22 may be configured such that the diameter of the pulley 282*a* of the second belt part 282 is the same as the diameter of the pulley 281*a* of the first belt part 281 so that a pull-out amount of the wire W by the movement of the pull-out roller 21 is the same as an amount of movement of the reinforcing bar binding machine 1A connected to the connected portion 22*d*. In addition, in order to amplify the torque for moving the pull-out roller 21, the diameter of the pulley 282*a* of the second belt part 282 may be configured to be larger than the diameter of the pulley 281*a* of the first belt part 281.

In the binding device 100B, the drive part 12 of the binding machine moving part the traveling part 14, and the reinforcing bar binding machine 1A are controlled by a controller 110B. In the binding device 100B, the operation of moving the reinforcing bar binding machine 1A by the binding machine moving part 10B is transmitted to the roller moving part 28, and the pull-out roller 27 pulls out the wire W by the operation of the roller moving part 28 in accordance with the movement of the reinforcing bar binding machine 1A. To this end, the controller 110B controls the wire feeding part 2B by controlling the drive part 12 of the binding machine moving part 10B.

Operation Example of Binding Device of Second Embodiment

Figure 6A:
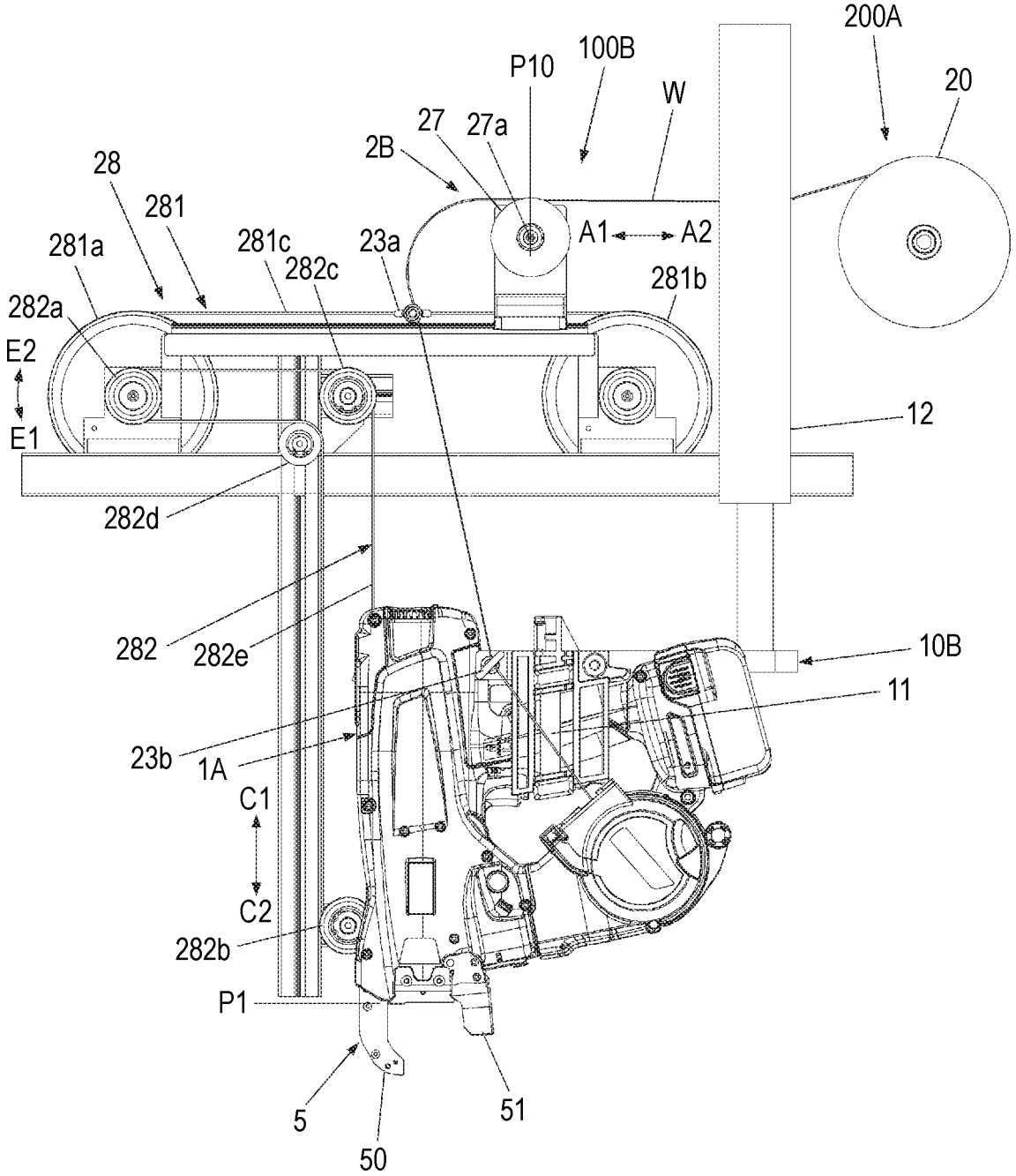
FIG. 6A is a front view of main parts showing an example of an operation of the binding device according to the second embodiment.
Figure 6B:
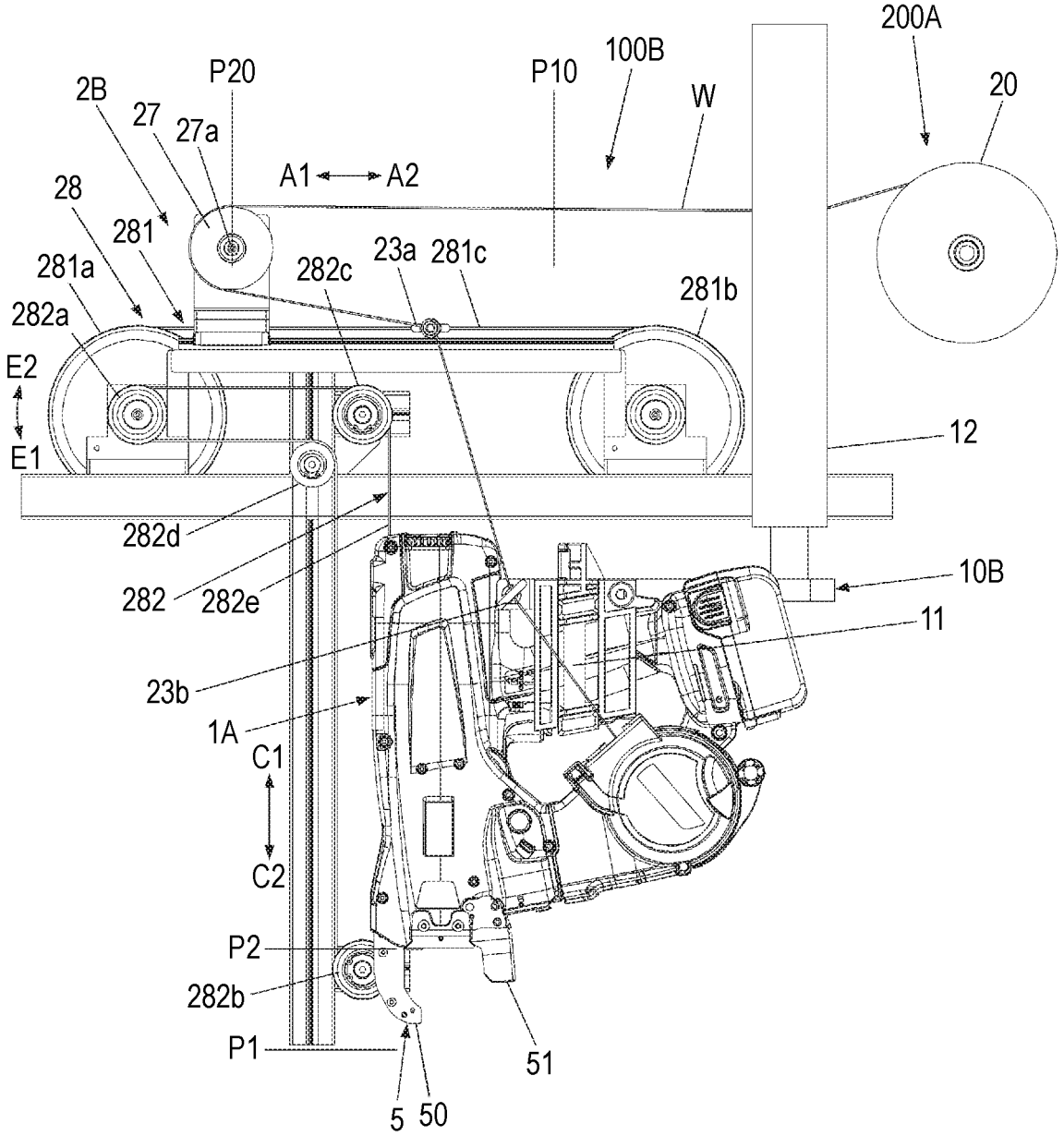
FIG. 6B is a front view of main parts showing the example of the operation of the binding device according to the second embodiment.
Figure 6C:
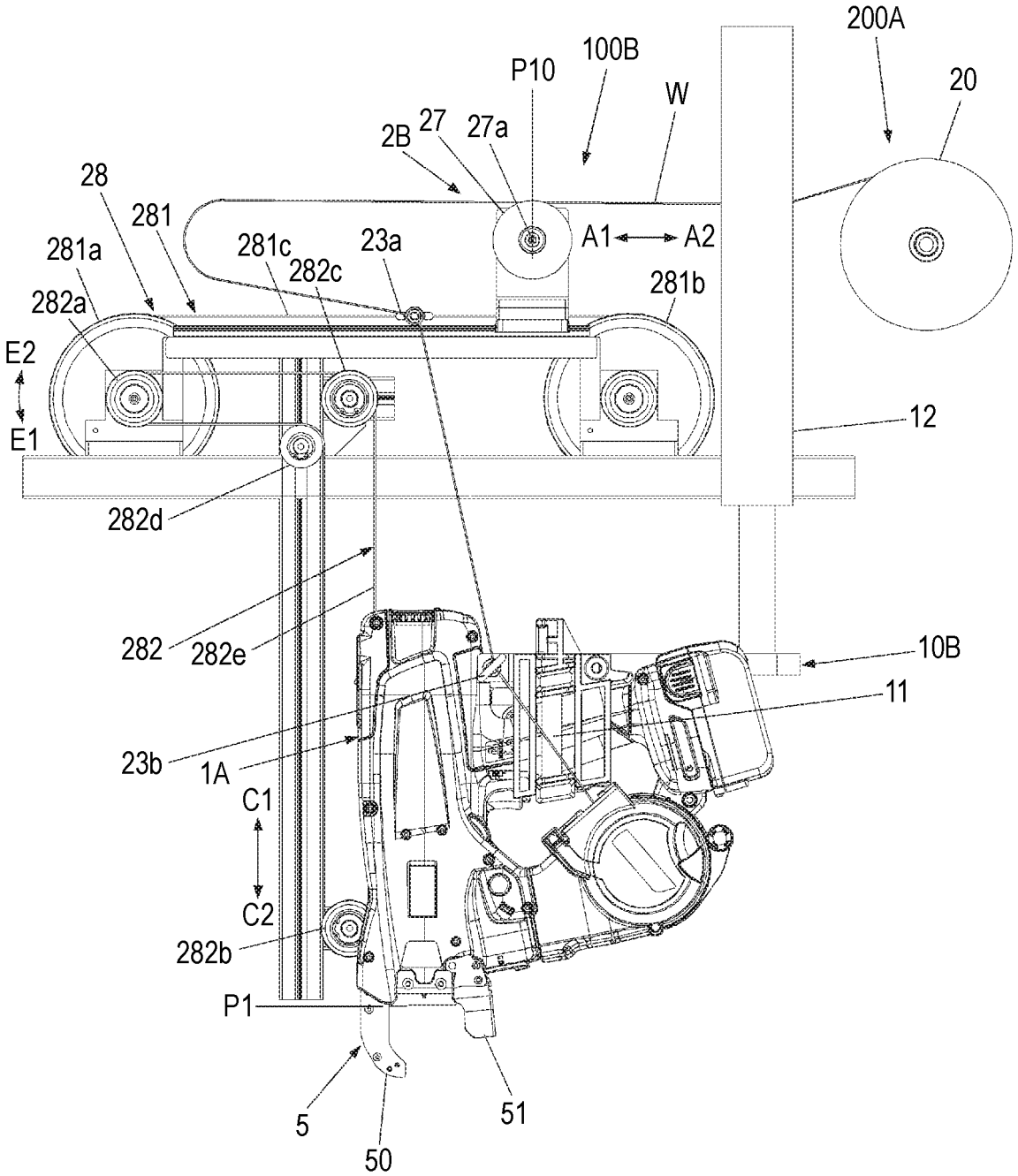
FIG. 6C is a front view of main parts showing the example of the operation of the binding device according to the second embodiment.

FIGS. 6A, 6B and 6C are front views of main parts showing an example of the operation of the binding device of the second embodiment. Referring to each drawing, an example of the operation of the binding device 100B in which the wire W is pulled out from the reel 20 and the wire W is made usable in the reinforcing bar binding machine 1A will be described.

In the binding device 100B, in a process where the reinforcing bar binding machine 1A is performing the binding operation, the reinforcing bar binding machine 1A is moved to the binding position P1, as shown in FIG. 6A. When the reinforcing bar binding machine 1A moves in the direction of the arrow C2 from the retreat position P2 shown in FIG. 6B to the binding position P1 shown in FIG. 6A, the portion of the second belt 282*e* of the second belt part 282, to which the binding machine mounting part 11 is connected, travels in the direction of the arrow C2, and the pulley 282*a* on which the second belt 282*e* is spanned rotates in the direction of arrow E2, in the roller moving part 28.

When the pulley 282*a* of the second belt part 282 rotates in the direction of the arrow E2, the pulley 281*a* of the first belt part 281 rotates in the direction of the arrow E2. When the pulley 281*a* of the first belt part 281 rotates in the direction of the arrow E2, the portion of the first belt 281*c* of the first belt part 281, to which the pull-out roller 27 is connected, travels in the direction of the arrow A2.

Thereby, when the reinforcing bar binding machine 1A moves in the direction of the arrow C2 from the retreat position P2 to the binding position Pb, the pull-out roller 27 moves in the direction of the arrow A2 in which it approaches the reel accommodation part 200A and becomes distant from the wire W pulled out from the reel 20. Then, when the reinforcing bar binding machine 1A is moved to the binding position Pb, the pull-out roller 27 is in a state of being moved to the standby position P10 distant from the wire W pulled out from the reel 20. In other words, when the reinforcing bar binding machine 1A moves in the direction of the arrow C2 from the retract position P2 to the binding position P1, the pull-out roller 27 moves in the direction of the arrow A2 and approaches the reel accommodation part 200A. As a result, the pull-out roller 27 becomes distant from a vertex of the wire W in the direction of the arrow A1.

In the binding device 100B, when the binding operation by the reinforcing bar binding machine 1A is completed, the controller 110B controls the drive part 12 of the binding machine moving part 10B to move the reinforcing bar binding machine 1A in the direction of the arrow C1 from the binding position P1 to the retreat position P2. When the reinforcing bar binding machine 1A moves in the direction of the arrow C1, the portion of the second belt 282*e* of the second belt part 282, to which the binding machine mounting part 11 is connected, travels in the direction of the arrow C1, and each pulley 282*a* on which the second belt 282*e* is spanned rotates in the direction of the arrow E1, in the roller moving part 28.

When the pulley 282*a* of the second belt part 282 rotates in the direction of the arrow E1, the pulley 281*a* of the first belt part 281 rotates in the direction of the arrow E1. When the pulley 281*a* of the first belt part 281 rotates in the direction of the arrow E1, the portion of the first belt 281*c* of the first belt part 281, to which the pull-out roller 27 is connected, travels in the direction of the arrow A1.

Thereby, when the reinforcing bar binding machine 1A moves in the direction of the arrow C1 from the binding position P1 to the retreat position P2, as shown in FIG. 6B, the pull-out roller 27 moves in the direction of the arrow A1 in which it becomes distant from the reel accommodation part 200A and the wire W is pulled out from the reel 20 accommodated in the reel accommodation part 200A. Then, when the reinforcing bar binding machine 1A moves to the retreat position P2, the pull-out roller 27 is in a state of being moved to the pull-out position P20 where the wire W is pulled out from the reel 20.

Note that the roller moving part 28 may be configured such that a diameter of the pulley 281*a* of the first belt part 281 is larger than a diameter of the pulley 282*a* of the second belt part 282 so that a pull-out amount of the wire W by the movement of the pull-out roller 21 is n times (n>1) as large as an amount of movement of the reinforcing bar binding machine 1A.

Thereby, the pull-out amount of the wire W by the movement of the pull-out roller 27 from the standby position P10 to the pull-out position P20 can be set to be predetermined n times, for example, about 3 times as large as the amount of movement of the reinforcing bar binding machine 1A from the binding position P1 to the retreat position P2, so that an amount of the wire W necessary for a next binding operation can be pulled out from the reel 20. With this pulling operation for the wire W, it is not necessary to match the amount of movement of the reinforcing bar binding machine 1A in accordance with the pull-out amount of the wire W necessary for the next binding operation, making it possible to reduce the amount of movement of the reinforcing bar binding machine 1A and to miniaturize the binding device 100B.

When the next binding operation starts after the pull-out operation for the wire W performed in conjunction with the movement of the reinforcing bar binding machine 1A is finished, the binding device 100B first moves the reinforcing bar binding machine 1A in the direction of the arrow C2 from the retreat position P2 to the binding position P1. When the reinforcing bar binding machine 1A moves in the direction of the arrow C2, the portion of the second belt 282*e* of the second belt part 282, to which the binding machine mounting part 11 is connected, travels in the direction of the arrow C2, and the pulley 282*a* on which the second belt 282*e* is spanned rotates in the direction of the arrow E2, in the roller moving part 28.

When the pulley 282*a* of the second belt part 282 rotates in the direction of the arrow E2, the pulley 281*a* of the first belt part 281 rotates in the direction of the arrow E2. When the pulley 281*a* of the first belt part 281 rotates in the direction of the arrow E2, the portion of the first belt 281*c* of the first belt part 281, to which the pull-out roller 27 is connected, travels in the direction of the arrow A2.

Thereby, when the reinforcing bar binding machine 1A moves in the direction of the arrow C2 from the retreat position P2 to the binding position P1, as shown in FIG. 6C, the pull-out roller 27 moves in the direction of the arrow A2 in which it approaches the reel accommodation part 200A and becomes distant from the wire W pulled out from the reel 20. Then, when the reinforcing bar binding machine 1A moves to the binding position, the pull-out roller 27 is in a state of being moved to the standby position P10 distant from the wire W pulled out from the reel 20. In other words, when the reinforcing bar binding machine 1A moves in the direction of the arrow C2 from the retract position P2 to the binding position Pb, as shown in FIG. 6C, the pull-out roller 27 moves in the direction of the arrow A2 and approaches the reel accommodation part 200A. As a result, the pull-out roller 27 becomes distant from a vertex of the wire W in the direction of the arrow A1.

When the reinforcing bar binding machine 1A moves to the binding position P1, the wire W pulled out from the reel 20 becomes loose between the reinforcing bar binding machine 1A and the reel 20. Thereby, in the operation of feeding the wire W by the wire feeding part 3 of the reinforcing bar binding machine 1A, a load for rotating the reel 20 and a load for rotating the pull-out roller 27 are not applied to the wire feeding part 3.

Therefore, an amount of the wire W necessary for winding around the two intersecting reinforcing bars S can be reliably fed by the wire feeding part 3. In addition, in the operation of feeding the wire W wound around the reinforcing bars S in the reverse direction indicated by the arrow R and winding the wire on the reinforcing bars S, the length of the wire W is suppressed from being insufficient, and therefore, the wire W can be reliably wound on the reinforcing bars S. Then, by reliably winding the wire W on the reinforcing bars S, the binding strength can be improved in the operation of twisting the wire W to bind the reinforcing bars S with the wire W.

Note that, also in the binding device 100B, the controller 110B can detect the load applied to the drive part 12 at the time of moving the pull-out roller 27 to pull out the wire W. Therefore, when the load upon pulling out the wire W is higher than a specified value, the controller 110B determines that a sufficient amount of the wire W cannot be pulled out from the reel 20, and may stop the movement of the reinforcing bar binding machine 1A that is performed by the drive part 12 and notify an alarm, in the course of moving the reinforcing bar binding machine 1A from the binding position P1 to the retreat position P2.

In addition, the controller 110B may calculate a remaining amount of the wire W wound on the reel 20, based on the load applied to the drive part 12.

Overall Configuration Example of Binding Device of Third Embodiment

Figure 7A:
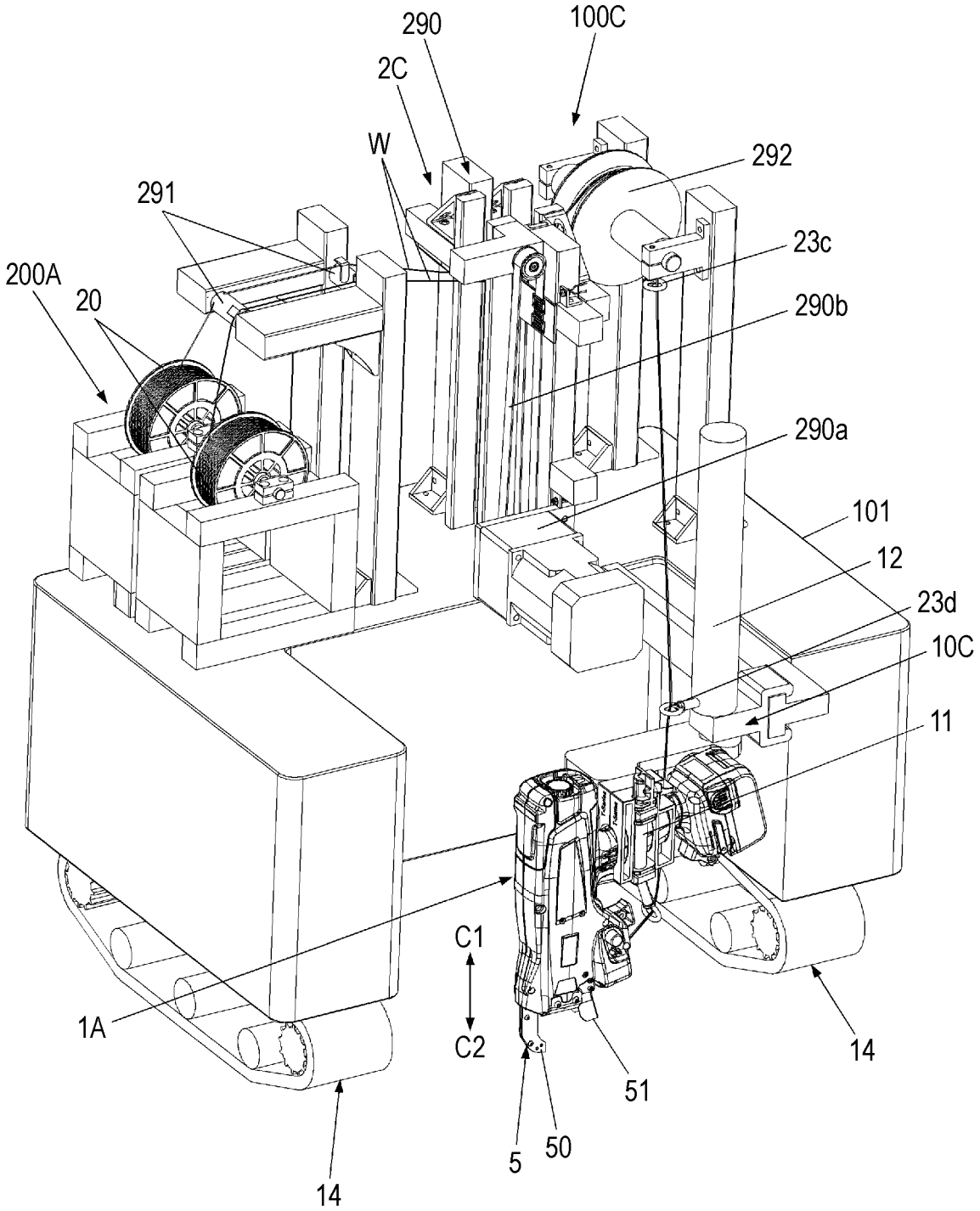
FIG. 7A is a perspective view showing an example of a binding device according to a third embodiment.
Figure 7B:
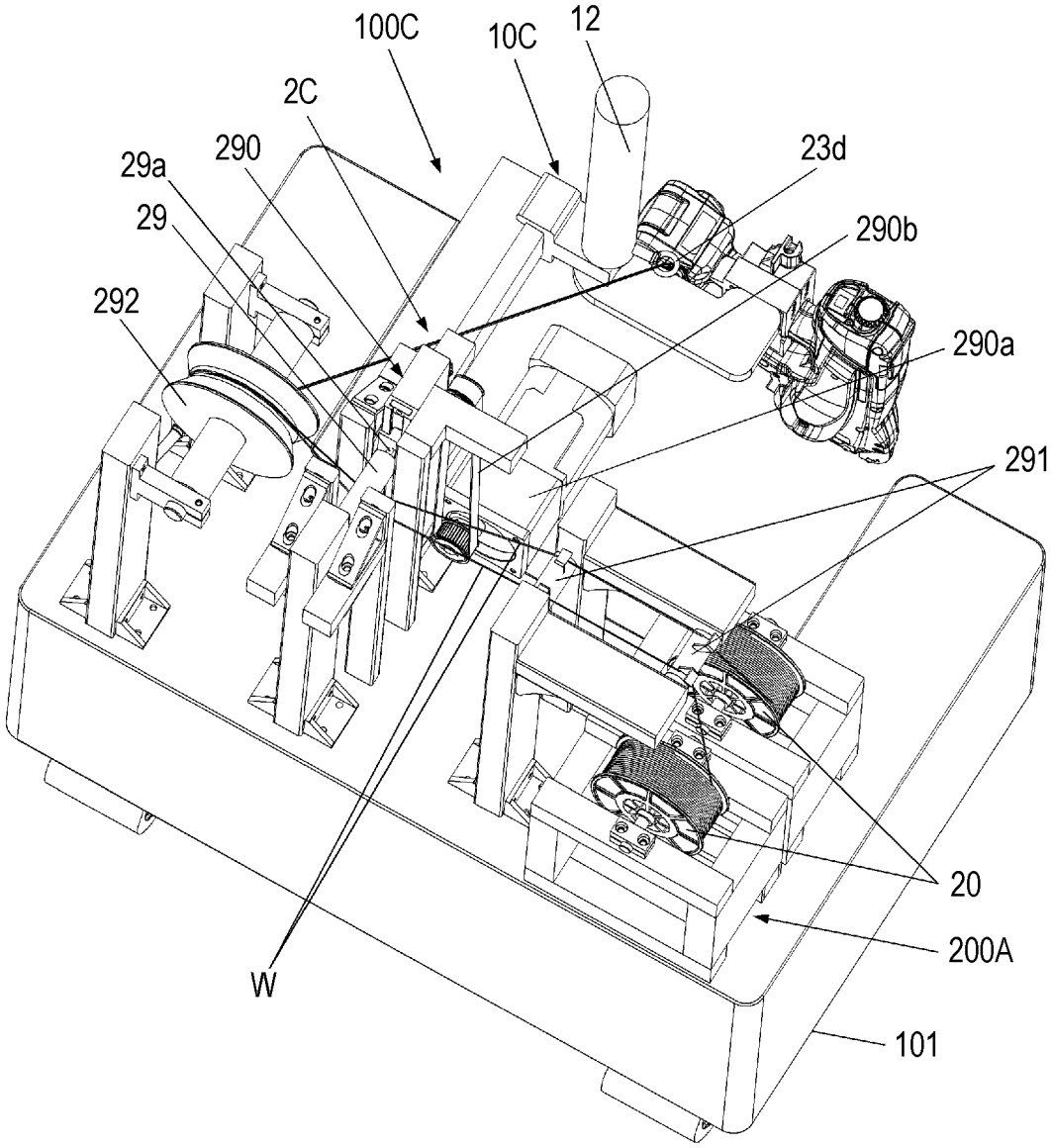
FIG. 7B is a perspective view showing the example of the binding device according to the third embodiment.
Figure 7C:
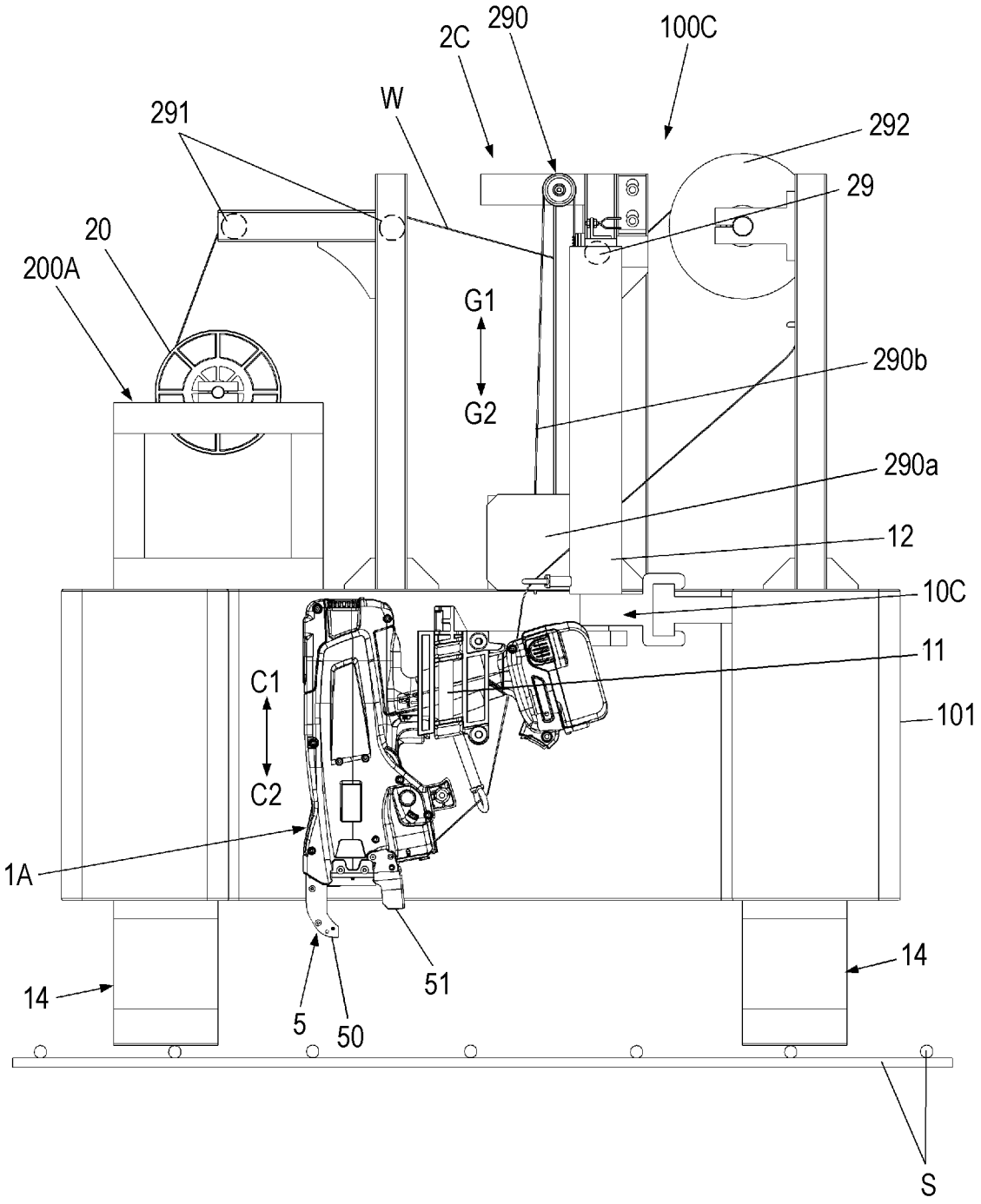
FIG. 7C is a front view showing the example of the binding device according to the third embodiment.
Figure 7D:
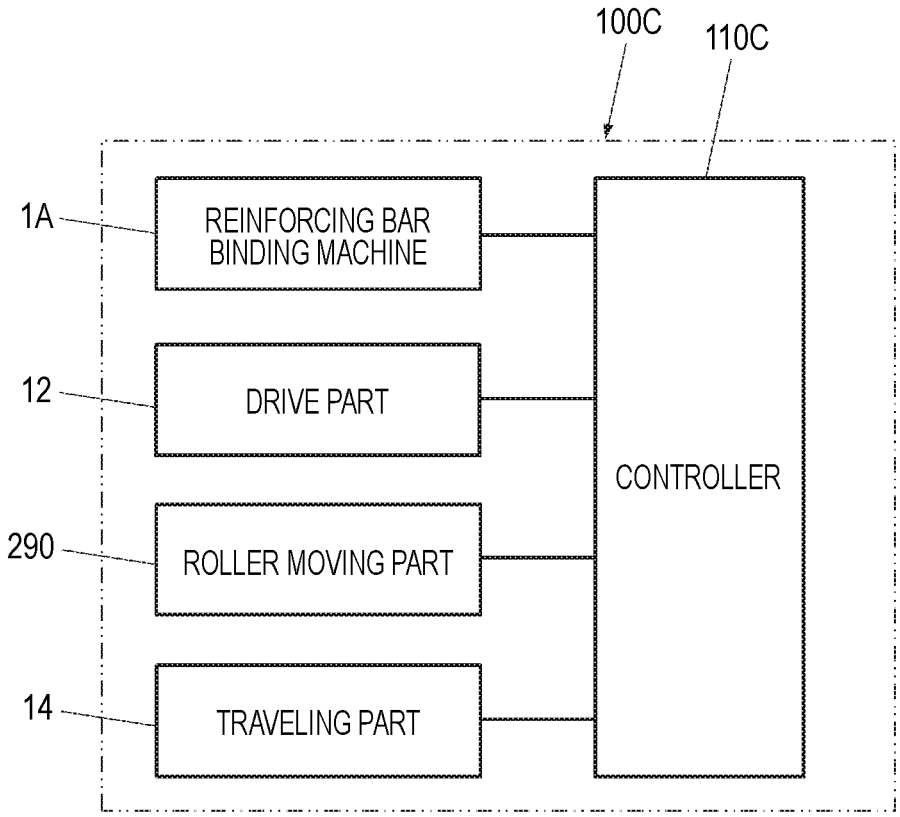
FIG. 7D is a functional block diagram showing the example of the binding device according to the third embodiment.

FIGS. 7A and 7B are perspective views showing an example of a binding device according to a third embodiment, and FIG. 7C is a front view showing the example of the binding device according to the third embodiment. In addition, FIG. 7D is a functional block diagram showing the example of the binding device according to the third embodiment.

A binding device 100C of the third embodiment includes a reinforcing bar binding machine 1A that binds intersections of reinforcing bars S arranged in a grid shape with a wire W, and a binding machine moving part 10C that moves the reinforcing bar binding machine 1A between a binding position and a retreat position.

In addition, the binding device 100C includes a wire pull-out part 2C that pulls out the wire W from a reel 20 on which the wire W that is used in the reinforcing bar binding machine 1A is wound, and a reel accommodation part 200A in which the reel 20 is accommodated.

Additionally, the binding device 100C includes a traveling part 14 that moves the entire binding device 100C along the arrangement surface of the reinforcing bars S.

The binding machine moving part 10C is an example of the binding mechanism moving part, and includes a binding machine mounting part 11 to which the reinforcing bar binding machine 1A is mounted, and a drive part 12 that moves the binding machine mounting part 11 in a vertical direction indicated by arrows C1 and C2. The drive part 12 includes a power source such as a motor and an actuator capable of controlling an amount of movement, a moving direction, a moving speed, and the like, and various mechanisms for converting movement (output) of the power source into movement in the directions of arrows C1 and C2 of the binding machine mounting part 11.

The binding machine moving part 10C moves the reinforcing bar binding machine 1A mounted to the binding machine mounting part 11 in an upward direction indicated by the arrow C1 by a predetermined amount, thereby moving the reinforcing bar binding machine 1A to the retreat position. In addition, the binding machine moving part 10B moves the reinforcing bar binding machine 1A mounted to the binding machine mounting part 11 in a downward direction indicated by the arrow C2 by a predetermined amount, thereby moving the reinforcing bar binding machine 1A from the retreat position to the binding position.

The wire pull-out part 2C includes a pull-out roller 29 provided on a feeding path of the wire W between the reinforcing bar binding machine 1A and the reel accommodation part 200A, and a roller moving part 290 that moves the pull-out roller 29. In addition, the wire pull-out part 2C includes a first wire guiding part 291 that guides the wire W between the pull-out roller 29 and the reel 20, and a second wire guiding part 292 that guides the wire W between the pull-out roller 29 and the reinforcing bar binding machine 1A. Additionally, the wire pull-out part 2C includes path induction members 23*c* and 23*d* that change a path along which the wire W is fed.

The pull-out roller 29 is an example of the pull-out member, is configured by a rotating body capable of rotating with a shaft 29*a* as a fulcrum, and has an outer circumferential surface that the wire W contacts. The pull-out roller 29 is provided between the first wire guiding part 291 and the second wire guiding part 292.

The roller moving part 290 includes a drive mechanism configured by a motor 290*a*, a belt 290*b*, and the like, and moves a position of the pull-out roller 29 in directions of arrows G1 and G2 intersecting the wire W between the first wire guiding part 291 and the second wire guiding part 292.

The roller moving part 290 moves the pull-out roller 29 in the direction of the arrow G1 in which the wire W guided by the first wire guiding part 291 is pulled out from the reel 20, from a standby position to a pull-out position by drive of the motor 290*a*. In addition, the roller moving part 290 moves the pull-out roller 29 in the direction of the arrow G2 in which it becomes distant from the wire W pulled out from the reel 20, from the pull-out position to the standby position, by drive of the motor 290*a*.

The first wire guiding part 291 is configured by a rotating body capable of rotating with a shaft as a fulcrum, has an outer circumferential surface that the wire W contacts, and rotates as the wire W is fed. The first wire guiding part 291 guides the feeding path of the wire W so that force is applied in the direction in which the wire W is pulled out from the reel 20, in an operation in which the pull-out roller 29 moves in the direction of the arrow G1 to pull out the wire W from the reel 20.

The second wire guiding part 292 is configured by a rotating body capable of rotating with a shaft as a fulcrum, has an outer circumferential surface that the wire W contacts, and rotates as the wire W is fed.

The pull-out roller 29 is moved from the standby position to the pull-out position, so that the wire pull-out part 2C applies force for pulling the wire W between the reel 20 and the first wire guiding part 291 and the wire W between the reinforcing bar binding machine 1A and the second wire guiding part 292, between the first wire guiding part 291 and the second wire guiding part 292.

It is switched whether the wire W on the first wire guiding part 291 side is fed or the wire W on the second wire guiding part 292 side is fed, depending on a change in magnitude of the load applied to the wire W guided by the first wire guiding part 291 and the wire W guided by the second wire guiding part 292. Thereby, a surplus of the wire W generated in the operations of feeding the wire Win the reverse direction and winding the wire on the reinforcing bars S with the reinforcing bar binding machine 1A is absorbed, and the wire W is pulled out from the reel 20 accommodated in the reel accommodation part 200A.

The path induction members 23*c* and 23*d* are provided on the feeding path of the wire W between the second wire guiding part 292 and the reinforcing bar binding machine 1A. The path induction members 23*c* and 23*d* are each configured by an annular member, and two wires W are caused to pass through central hole portions of the annular members, so that the feeding path of the wire W along the horizontal direction is bent into the feeding path of the wire W along the vertical direction. Since portions of the path induction members 23*c* and 23*d* that the wire W contacts are curved surfaces, an increase in resistance due to frictional movement is suppressed.

In the binding device 100C, the drive part 12 of the binding machine moving part 10C, the motor 290*a* of the roller moving part 290, the traveling part 14, and the reinforcing bar binding machine 1A are controlled by a controller 110C. The controller 110C controls the motor 290*a* of the roller moving part 290 to actuate the wire pull-out part 2B in accordance with a timing of controlling the drive part 12 of the binding machine moving part 10C to move the reinforcing bar binding machine 1A. Thereby, the wire pull-out part 2C pulls out the wire W at a timing when the reinforcing bars S are not bound by the reinforcing bar binding machine 1A.

Operation Example of Binding Device of Third Embodiment

FIGS. 8A, 8B, FIGS. 8C and 8D are front views of main parts showing an example of the operation of the binding device of the third embodiment. Referring to each drawing, an example of the operation of the binding device 100C in which the wire W is pulled out from the reel 20 and the wire W is made usable in the reinforcing bar binding machine 1A will be described.

Figure 8A:
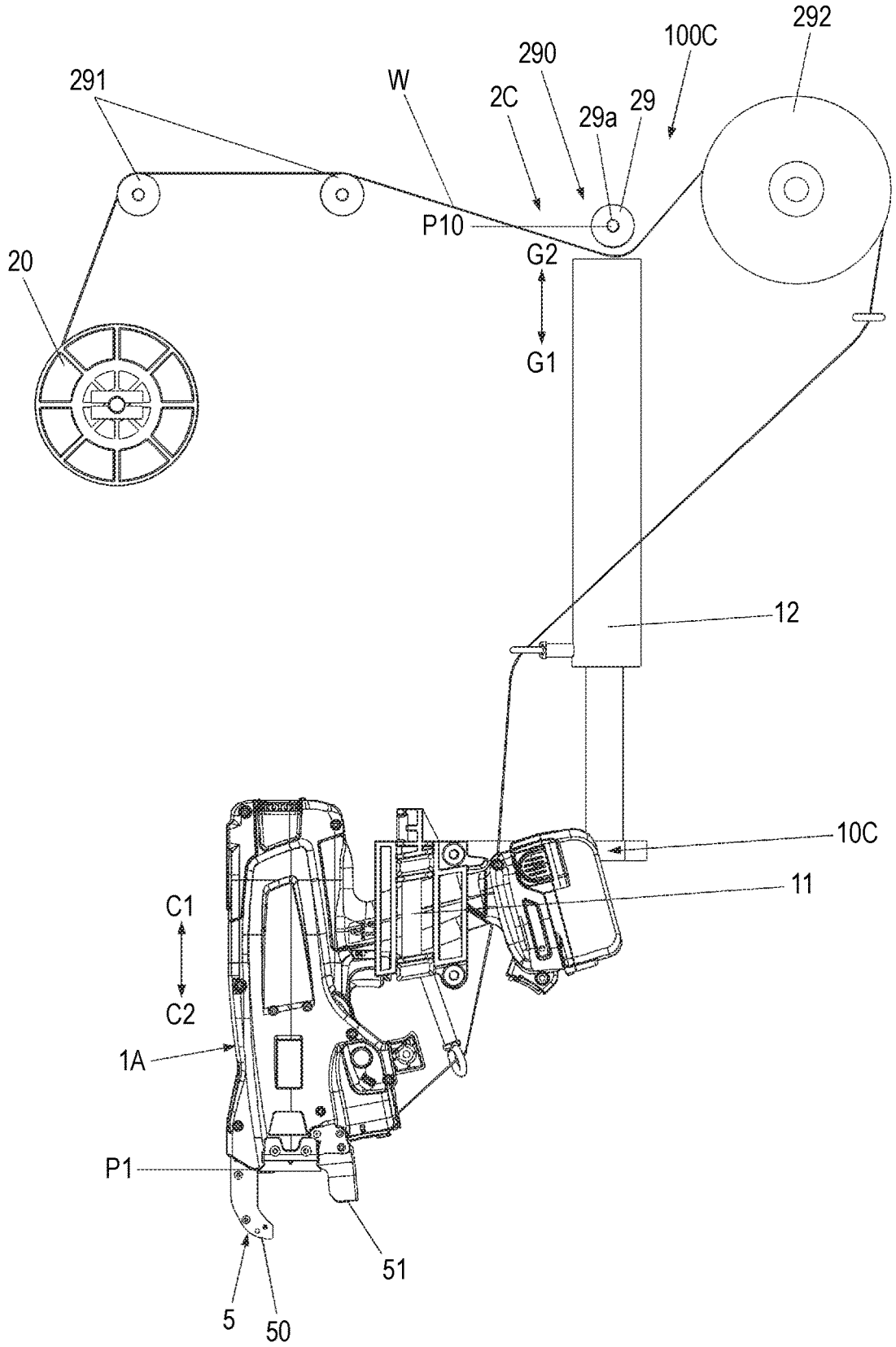
FIG. 8A is a front view of main parts showing an example of an operation of the binding device according to the third embodiment.

In the binding device 100C, in a process where the reinforcing bar binding machine 1A is performing the binding operation, the reinforcing bar binding machine 1A is moved to the binding position P1, as shown in FIG. 8A. In addition, in the process where the reinforcing bar binding machine 1A is performing the binding operation, the wire pull-out part 2C moves the pull-out roller 29 in the direction of the arrow G2 from the pull-out position P20 to the standby position P10 by drive of the motor 290*a*.

Thereby, in the process where the reinforcing bar binding machine 1A is performing the binding operation, the pull-out roller 29 is in a state of being moved to the standby position P10 distant from the wire W pulled out from the reel 20, as will be described later.

Figure 8B:
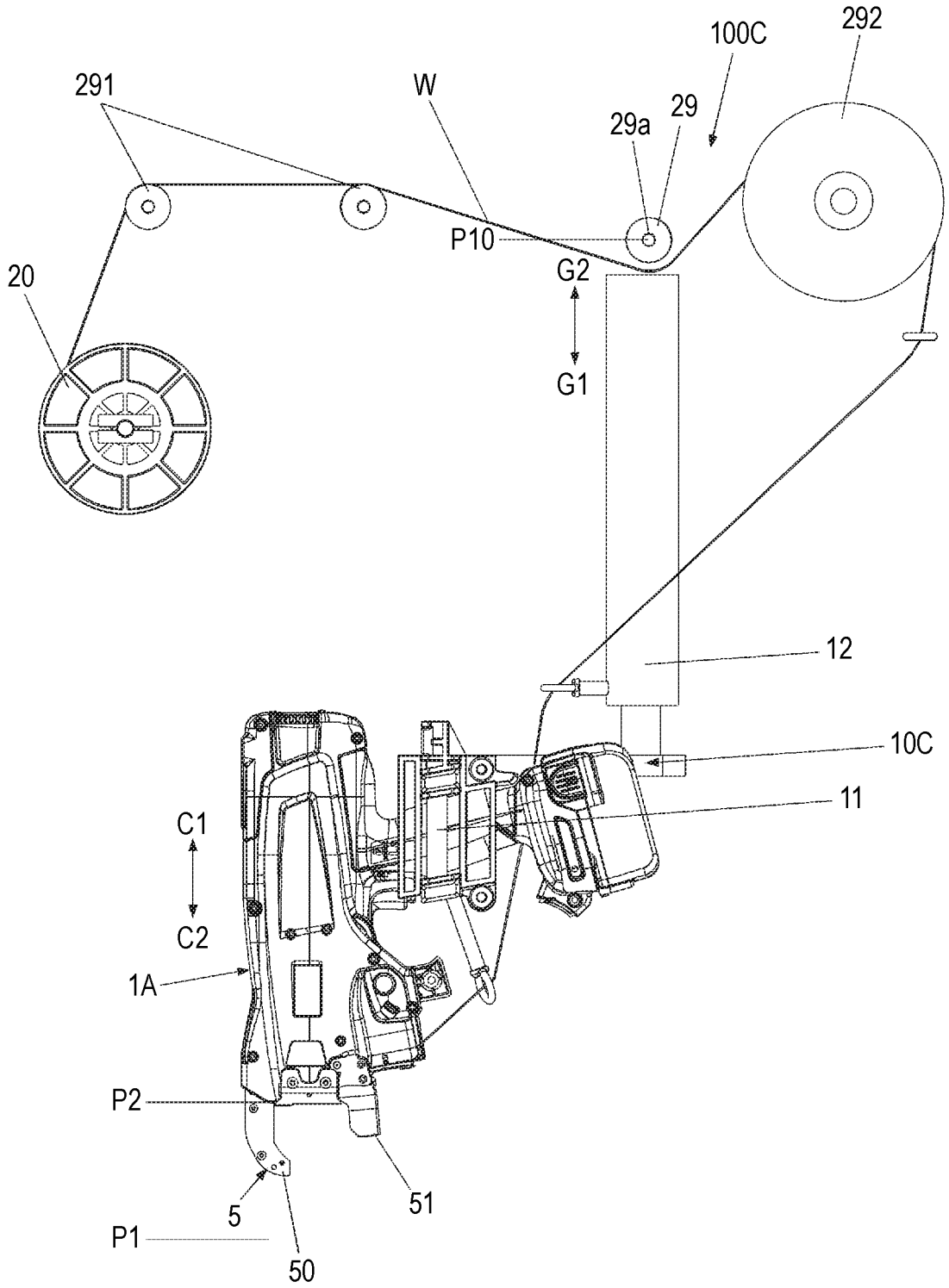
FIG. 8B is a front view of main parts showing the example of the operation of the binding device according to the third embodiment.
Figure 8C:
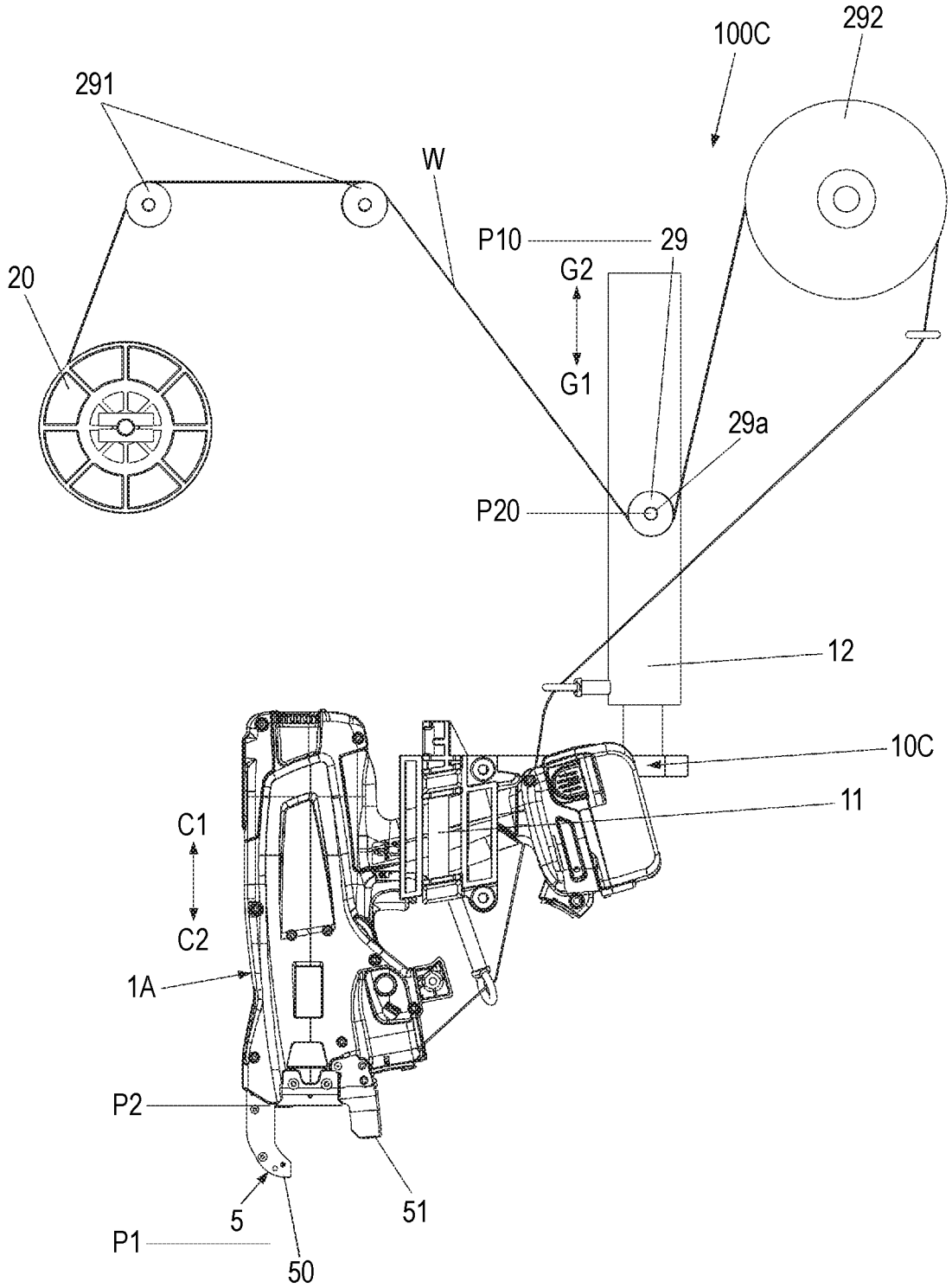
FIG. 8C is a front view of main parts showing the example of the operation of the binding device according to the third embodiment.

In the binding device 100C, when the binding operation by the reinforcing bar binding machine 1A is completed, the controller 110C controls the drive part 12 of the binding machine moving part 10C to move the reinforcing bar binding machine 1A in the direction of the arrow C1 from the binding position P1 to the retreat position P2, as shown in FIG. 8B. In addition, when the binding operation by the reinforcing bar binding machine 1A is completed, the controller 110C controls the motor 290*a* of the roller moving part 290, and as shown in FIG. 8C, the wire pull-out part 2C moves the pull-out roller 29 in the direction of the arrow G1 in which the wire W guided by the first wire guiding part 291 is pulled out from the reel 20 by drive of the motor 290*a*.

Thereby, the pull-out roller 29 is in a state of being moved to the pull-out position P20 where the wire W is pulled out from the reel 20. In addition, in the roller moving part 290, an amount of movement of the pull-out roller 29 is set so that an amount of the wire W necessary for a next binding operation can be pulled out from the reel 20.

When the next binding operation starts after the pull-out operation for the wire W is finished, the binding device 100C moves the reinforcing bar binding machine 1A in the direction of the arrow C2 from the retreat position P2 to the binding position P1. In addition, the wire pull-out part 2C moves the pull-out roller 29 in the direction of the arrow G2 in which the pull-out roller 29 becomes distant from the wire W pulled out from the reel 20 by drive of the motor 290*a*.

Figure 8D:
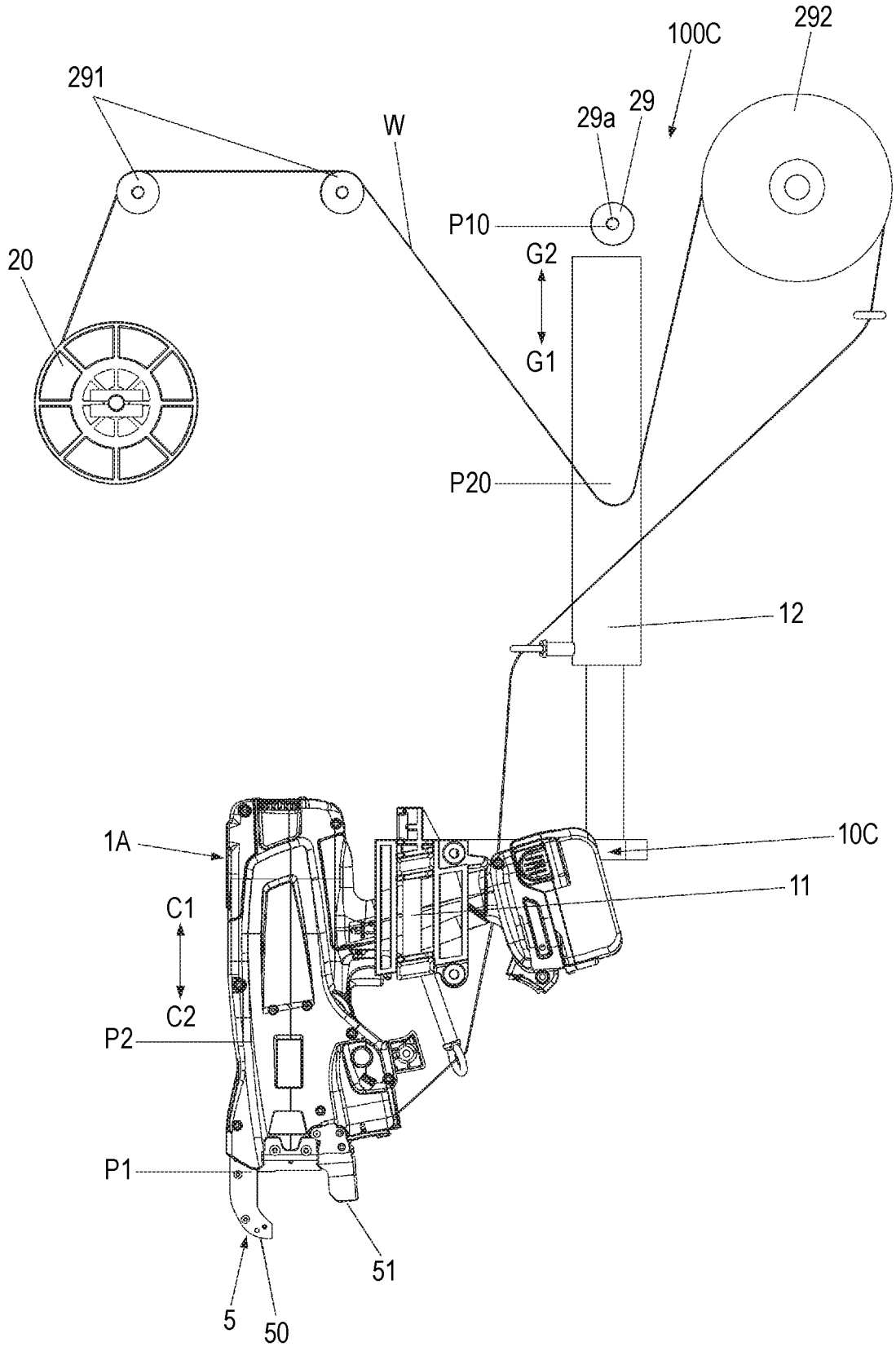
FIG. 8D is a front view of main parts showing the example of the operation of the binding device according to the third embodiment.

Thereby, as shown in FIG. 8D, the pull-out roller 29 is in a state of being moved to the standby position P10 distant from the wire W pulled out from the reel 20.

When the pull-out roller 29 moves to the standby position P10, the wire W pulled out from the reel 20 becomes loose between the reinforcing bar binding machine 1A and the reel 20. Thereby, in the operation of feeding the wire W by the wire feeding part 3 of the reinforcing bar binding machine 1A, a load for rotating the reel 20 and a load for rotating the pull-out roller 29 are not applied to the wire feeding part 3.

Therefore, an amount of the wire W necessary for winding around the two intersecting reinforcing bars S can be reliably fed by the wire feeding part 3. In addition, in the operation of feeding the wire W wound around the reinforcing bars S in the reverse direction indicated by the arrow R and winding the wire on the reinforcing bars S, the length of the wire W is suppressed from being insufficient, and therefore, the wire W can be reliably wound on the reinforcing bars S. Then, by reliably winding the wire W on the reinforcing bars S, the binding strength can be improved in the operation of twisting the wire W to bind the reinforcing bars S with the wire W.

Note that, also in the binding device 100C, the controller 110C can detect the load applied to the motor 290*a* of the roller moving part 290 at the time of moving the pull-out roller 29 to pull out the wire W. Therefore, when the load upon pulling out the wire W is higher than a specified value, the controller 110C determines that a sufficient amount of the wire W cannot be pulled out from the reel 20, and may stop the movement of the pull-out roller 29 that is performed by the motor 290*a* of the roller moving part 290 and notify an alarm, in the course of moving the reinforcing pull-out roller 29 from the standby position P10 to the pull-out position P20.

In addition, the controller 110C may calculate a remaining amount of the wire W wound on the reel 20, based on the load applied to the motor 290*a* of the roller moving part 290.

Configuration Example of Braking Part

Figure 9A:
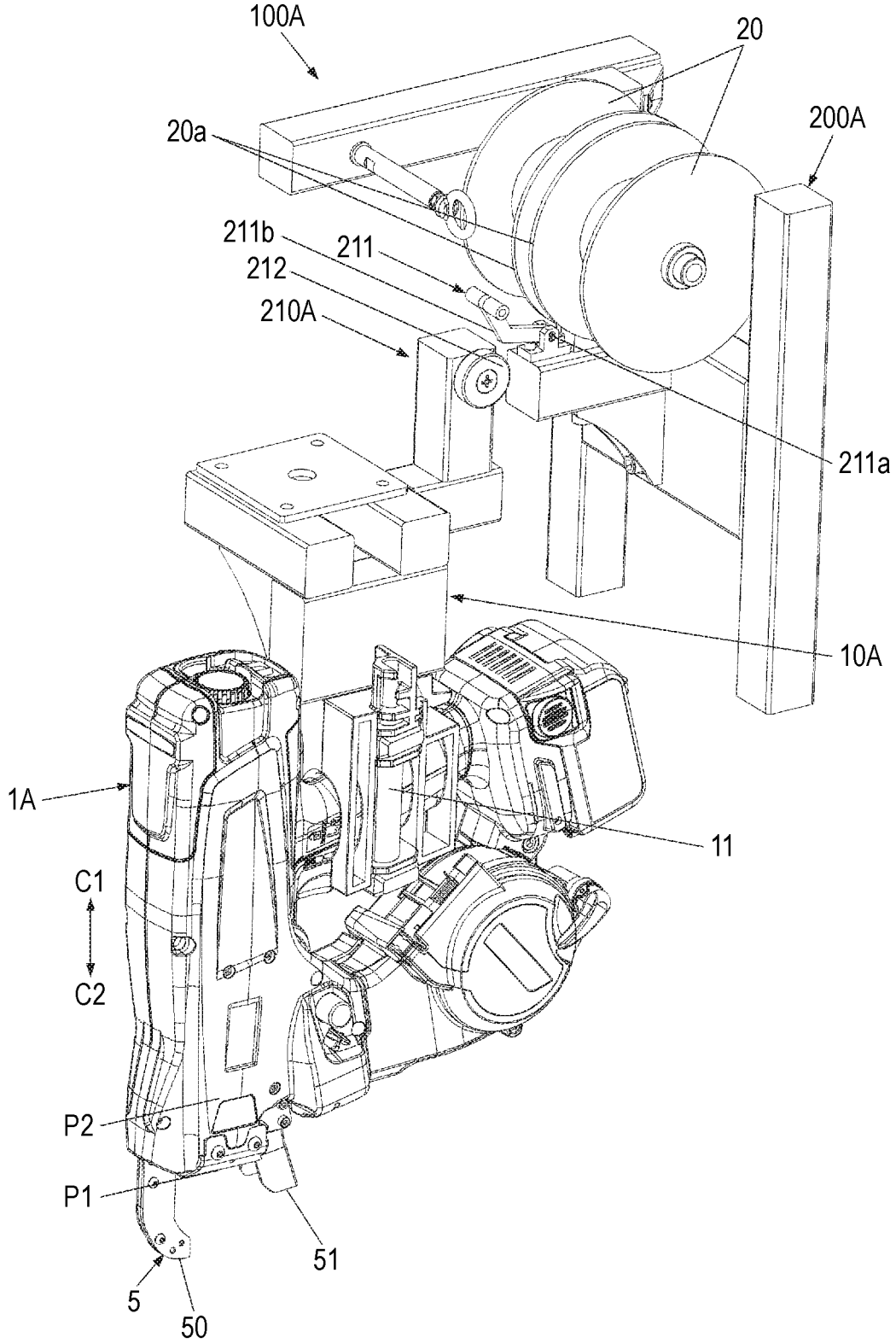
FIG. 9A is a perspective view showing an example of a braking part.
Figure 9B:
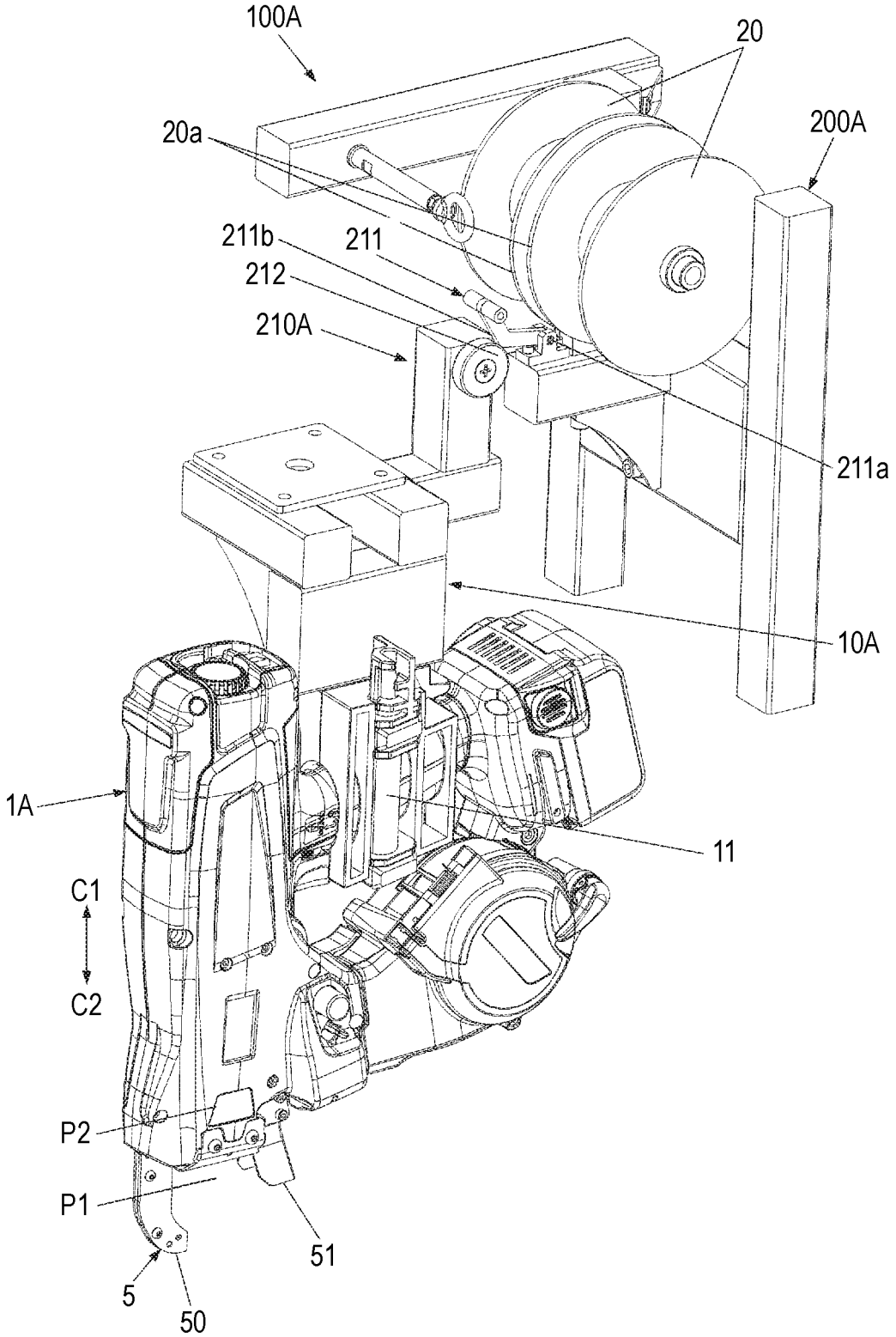
FIG. 9B is a perspective view showing the example of the braking part.
Figure 9C:
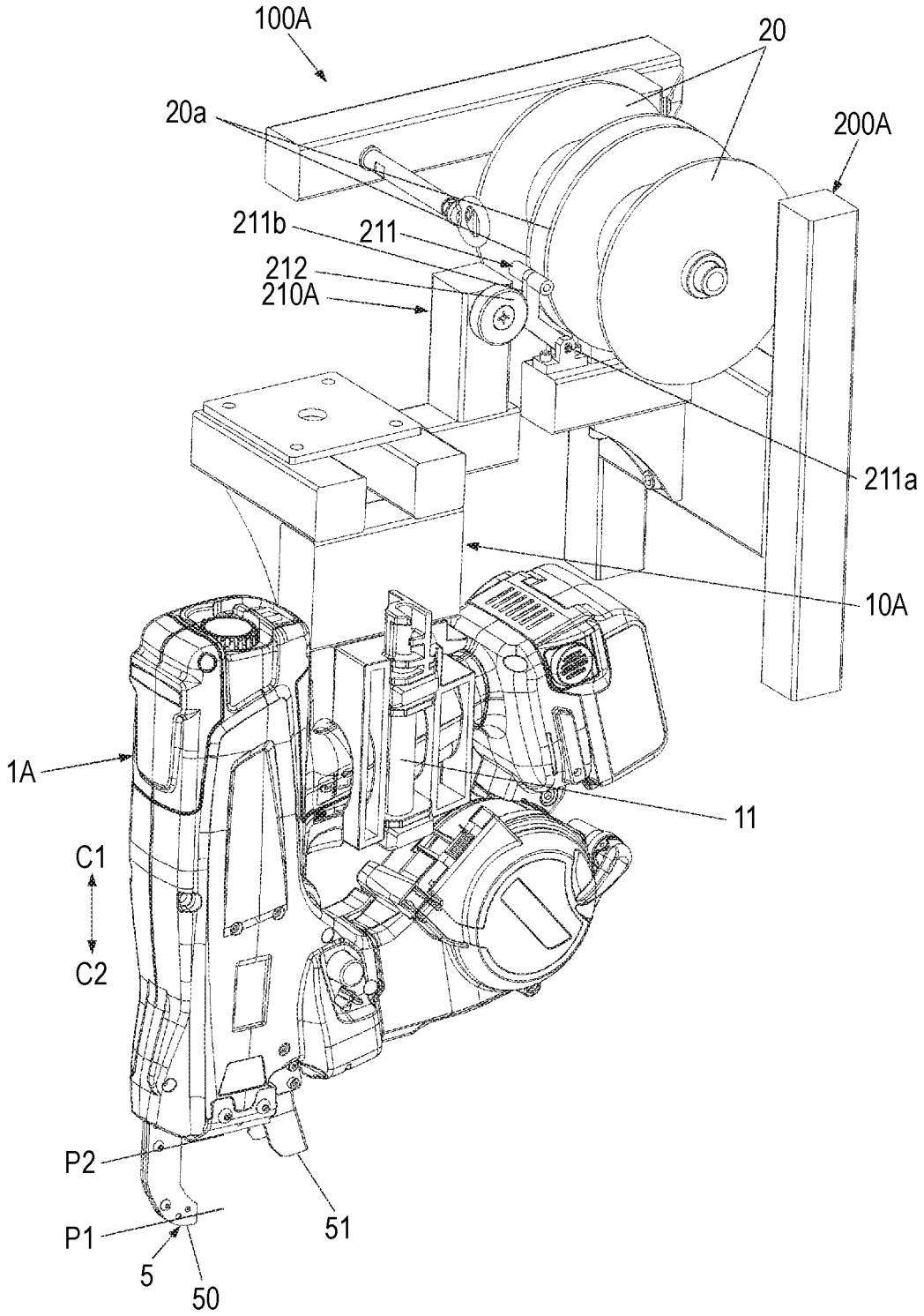
FIG. 9C is a perspective view showing the example of the braking part.
Figure 10A:
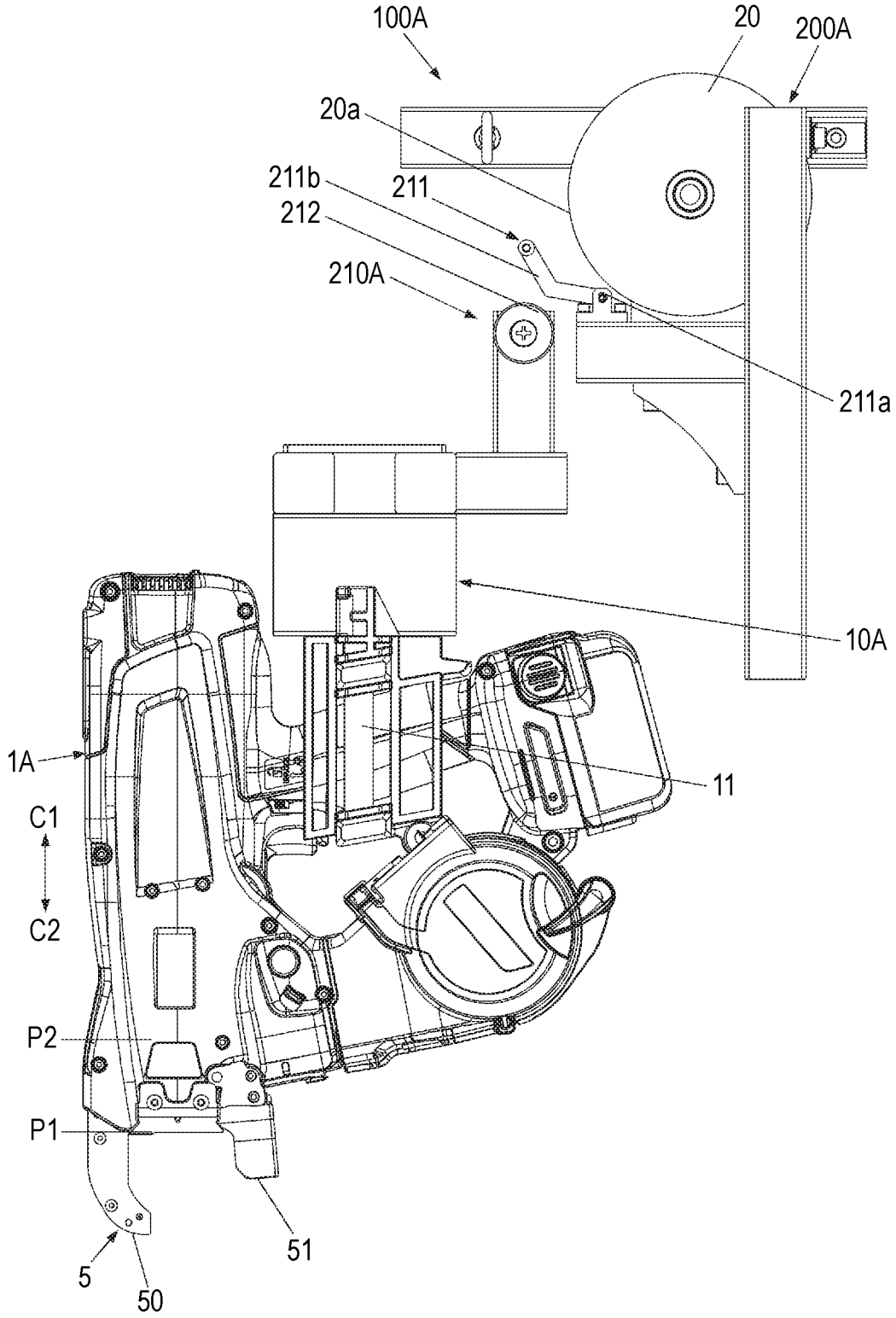
FIG. 10A is a front view showing the example of the braking part.
Figure 10B:
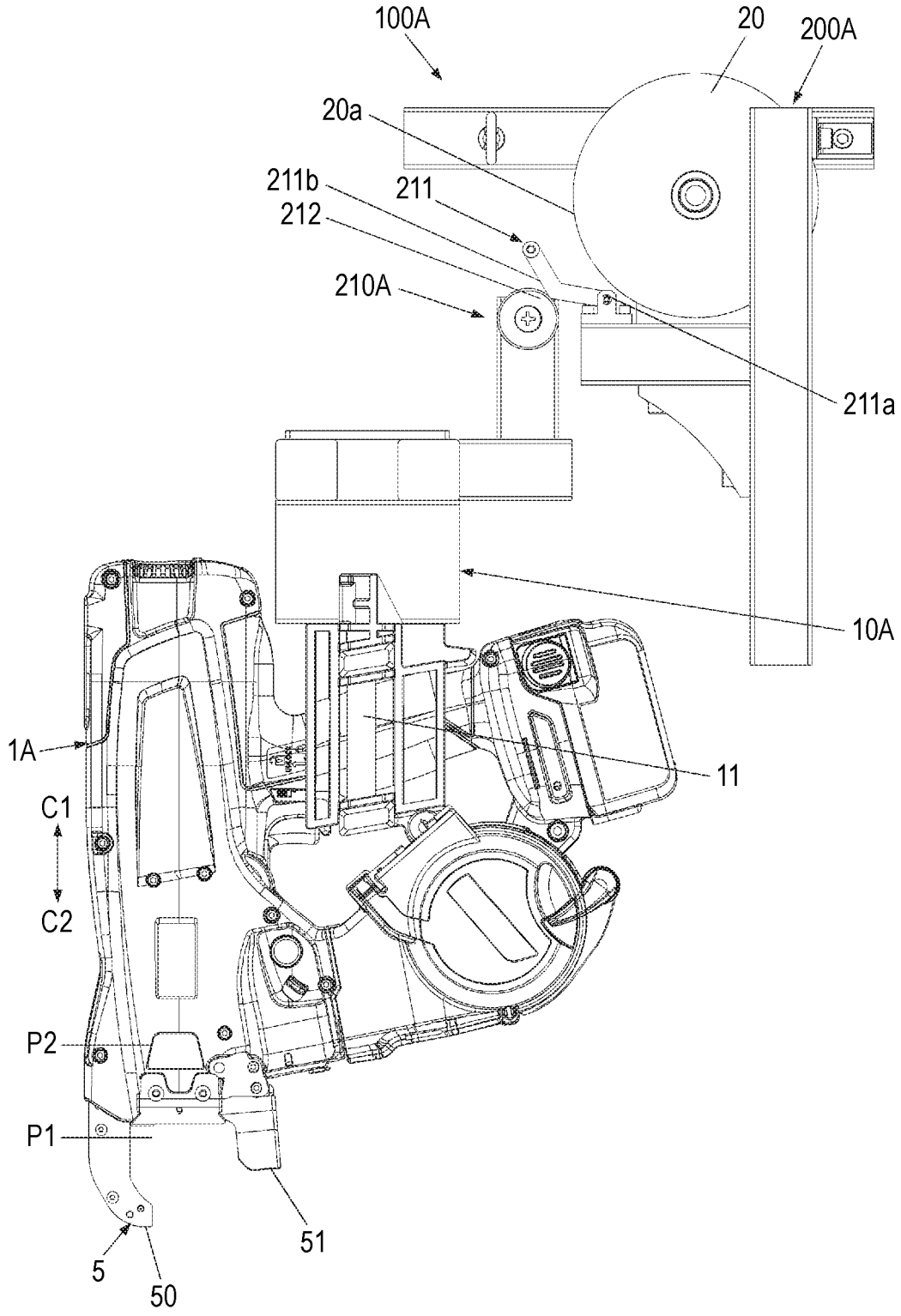
FIG. 10B is a front view showing the example of the braking part.
Figure 10C:
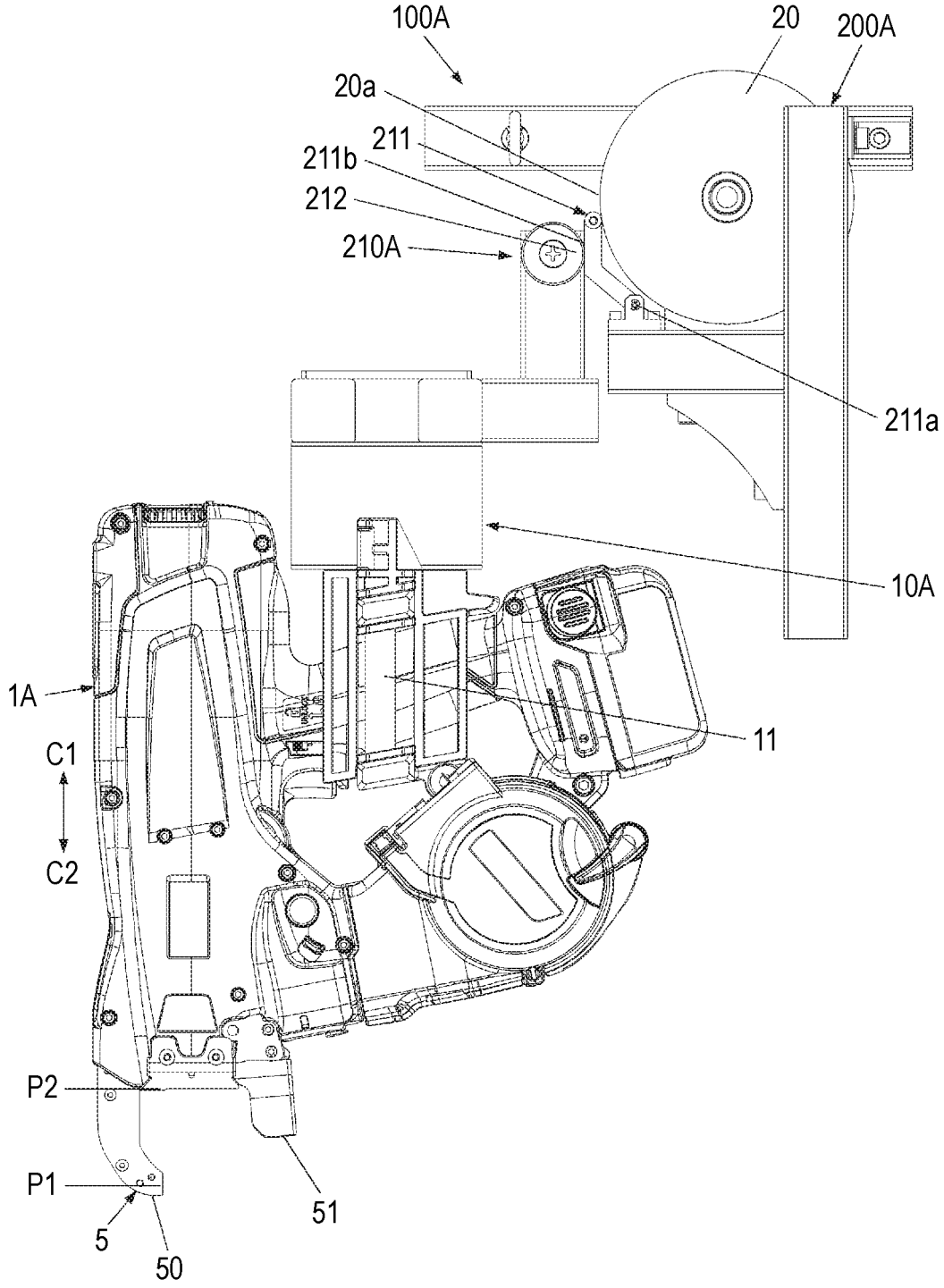
FIG. 10C is a front view showing the example of the braking part.

FIGS. 9A, 9B and 9C are perspective views showing an example of a braking part, and FIGS. 10A, 10B and 10C are front views showing the example of the braking part, showing an example of a configuration and an operation of a braking part 210A that suppresses rotation of the reel 20. In the following example, a configuration in which the binding device 100A is provided with the braking part 210A will be described.

The braking part 210A includes a braking member 211 in contact with an outer edge of a flange portion 20*a* of the reel 20, and an actuating member 212 that actuates the braking member 211.

The braking member 211 moves between a braking position where it comes into contact with the flange portion 20*a* of the reel 20 and a retreat position distant from the flange portion 20*a* of the reel 20 by a rotating operation with a shaft 211*a* as a fulcrum, in the present example. In a state of being moved to the braking position, the braking member 211 is formed with an action surface 211*b* extending in a direction along the moving direction of the reinforcing bar binding machine 1A indicated by arrows C1 and C2. The braking member 211 may be configured to be urged in a direction in which it rotates toward the retreat position by an urging member (not shown) such as a spring, or may be configured to rotate toward the retreat position by its own weight.

The actuating member 212 is provided for the binding machine mounting part 11 of the binding machine moving part 10A, to which the reinforcing bar binding machine 1A is mounted, and moves in the directions of the arrows C1 and C2 in conjunction with the movement of the reinforcing bar binding machine 1A. When the reinforcing bar binding machine 1A is moved to the binding position P1 shown in FIG. 4A and the like, the actuating member 212 separates from the braking member 211, as shown in FIGS. 9A and 10A. When the actuating member 212 separates, the braking member 211 moves to the retreat position distant from the flange portion 20*a* of the reel 20 by a rotating operation with the shaft 211*a* as a fulcrum.

In an operation in which the reinforcing bar binding machine 1A moves in the direction of the arrow C1 from the binding position P1 to the retreat position P2 shown in FIG. 4B and the like, the actuating member 212 comes into contact with an action surface 211*b* of the braking member 211, as shown in FIGS. 9B and 10B. The braking member 211 rotates from the retreat position toward the braking position by a rotating operation with the shaft 211*a* as a fulcrum, when the actuating member 212 moving in the direction of the arrow C1 in conjunction with the movement of the reinforcing bar binding machine 1A comes into contact with the action surface 211*b*.

When the reinforcing bar binding machine 1A is moved to the retreat position P2, the actuating member 212 pushes up the action surface 211*b* of the braking member 211, as shown in FIGS. 9C and 10B. When the actuating member 212 is moved to a position where the reinforcing bar binding machine 1A is moved to the retreat position P2, the braking member 211 is moved to the braking position by the rotating operation with the shaft 211*a* as a fulcrum.

In the braking part 210A, when the braking member 211 is moved to the braking position, the braking member 211 comes into contact with the flange portion 20*a* of the reel 20. In a configuration where two reels 20 are provided, the braking member 211 comes into contact with the flange portion 20*a* of each reel 20. This suppresses rotation of the reel 20.

As described above, with the operation in which the reinforcing bar binding machine 1A is moved in the direction of the arrow C1 from the binding position P1 to the retreat position P2, the pull-out roller 21 is moved in the direction of the arrow A1 to pull out the wire W from the reel 20, thereby causing the reel 20 to rotate. After stopping the movement of the pull-out roller 21 in the direction of the arrow A1, the rotation of the reel 20 tries to rotate due to the inertia. However, when the reinforcing bar binding machine 1A moves to the retreat position P2 and the pull-out roller 21 moves to the pull-out position P20, the braking member 211 of the braking part 210A comes into contact with the flange portion of the reel 20, and therefore, the rotation of the reel 20 is suppressed. Thereby, a situation is suppressed in which after the movement of the pull-out roller 21 is stopped, the reel 20 continues to rotate due to the inertia, so an excessive amount of the wire W is sent out from the reel 20.

Further, in the braking part 210A, in a state where the braking member 211 is moved to the braking position, the action surface 211*b* pushed by the actuating member 212 extends in a direction along the moving direction of the reinforcing bar binding machine 1A indicated by arrows C1 and C2. Thereby, even when the stop position of the reinforcing bar binding machine 1A moving in the direction of the arrow C1 is shifted further upward than the predetermined retreat position, the force of the braking member 211 pushing the flange portion 20*a* of the reel 20 is suppressed from being excessive, so overload is suppressed from being applied to the braking member 211 or the reel 20.

Note that the binding device 100A is in a state in which the reinforcing bar binding machine 1A is moved to the retreat position P2 during the traveling operation of the traveling part 14. Thereby, the rotation of the reel 20 is suppressed by the operation of the braking part 210, and therefore, a situation is suppressed in which vibration caused by the movement of the binding device 100A causes the reel 20 to rotate and the wire W is sent out from the reel 20.

In addition, the braking part may be configured to operate by a separate power source without being associated with the movement of the reinforcing bar binding machine 1A. In this case, only the timing at which the wire W is pulled out from the reel 20 may be controlled so that the braking member 211 is moved in a direction of getting away from the reel 20.

Further, the braking part may be configured to contact a side of the flange portion not to contact the outer edge of the flange portion 20*a* of the reel 20.

Figure 11:
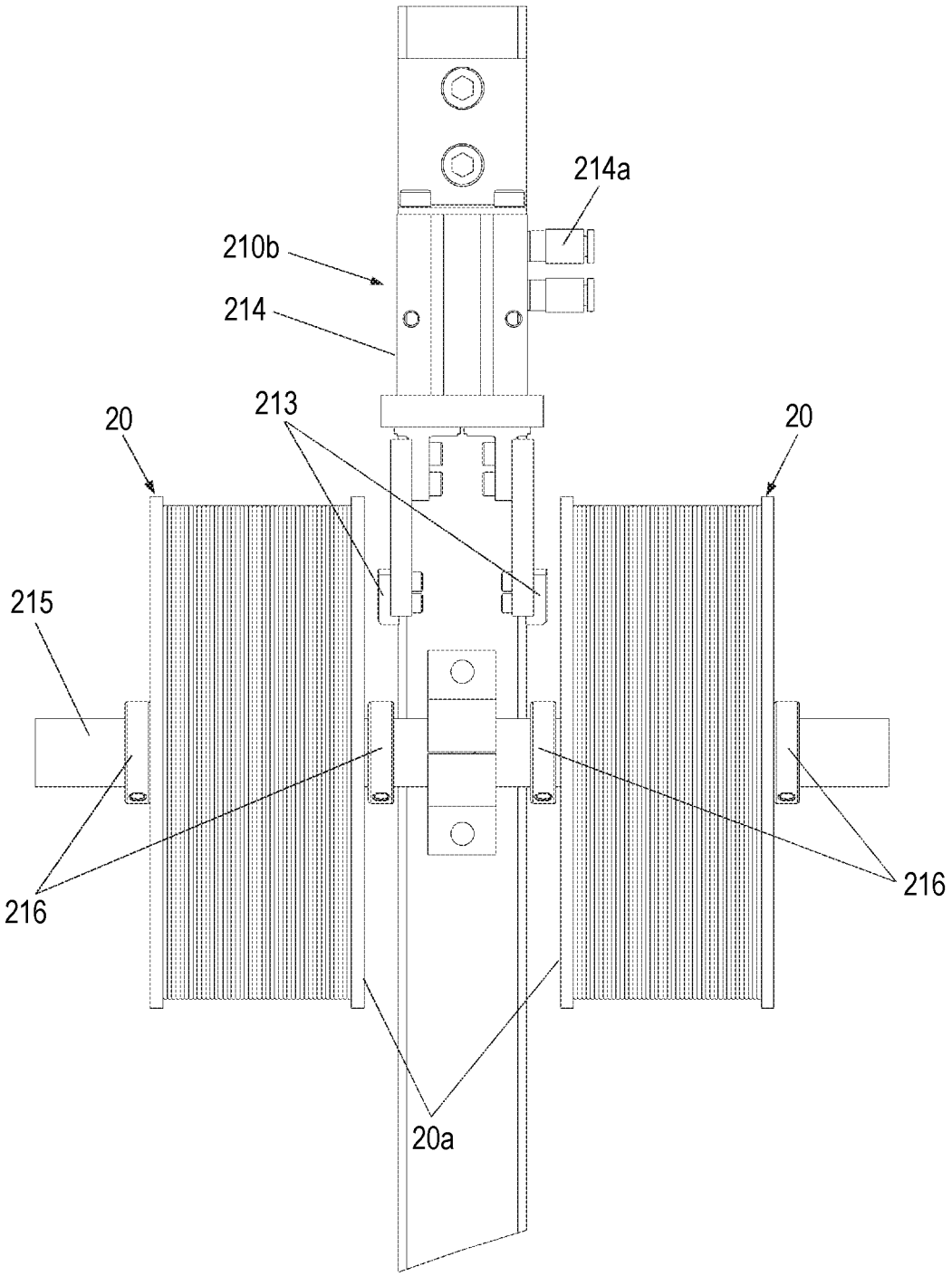
FIG. 11 is a top view showing another example of the braking part.

FIG. 11 is a top view showing another example of the braking part, which is a braking part that operates by a separate power source and has a configuration in which the braking member comes into contact with a side of the flange portion 20*a* of the reel 20.

The braking part 210B includes a braking member 213 that comes into contact with a side of the flange portion 20*a* of the reel 20, and an actuating part 214 that actuates the braking member 213. In a configuration where two reels 20 are provided so as to bind the reinforcing bars S with two wires W, two braking members 213 each corresponding to each reel 20 are provided between the reels 20.

Each braking member 213 is provided to be movable in directions of approaching and getting away from a side of the flange portion 20*a* of the reel 20, and moves between a braking position where it comes into contact with the side of the flange portion 20*a* of the reel 20 and a retreat position where it becomes distant from the side of the flange portion 20*a* of the reel 20.

The actuating part 214 actuates the braking member 213 by using air pressure as a power source, in the present example. To this end, the actuating part 214 is provided with a hose connecting portion 214*a* to which a hose from a supply source (not shown) of compressed air is connected.

Note that since the braking part 210B is configured such that the braking member 213 comes into contact with the side of the flange portion 20*a* of the reel 20, when the braking member 213 is moved to the braking position, force to move the reel 20 in the axial direction is applied. Therefore, in order to suppress movement of the reel 20 along the axial direction, a position regulation member 216 is provided on a shaft 215 that supports the reel 20.

Although the braking part 21B is configured to be actuated by the air pressure, it may also be configured to be actuated by a motor or actuator that is driven by electricity.

In addition, since the braking part is for suppressing unintended rotation of the reel due to the vibration or inertia, a member that applies load in the rotating direction, such as a rotary damper or a disk damper, may be provided at a support portion for the reel 20.

What is claimed is:

1. A binding device comprising:

a binding mechanism configured to feed a wire around a reinforcing bar, and to twist and bind the wire fed around the reinforcing bar;

a binding mechanism moving part including a binding machine mounting part to which the binding mechanism is mounted and a drive part that is configured to move the binding machine mounting part, the binding mechanism moving part being configured to move the binding mechanism between a binding position where binding of the reinforcing bar is performed and a retreat position distant from the reinforcing bar; and a wire pull-out part configured to pull out the wire wound on a reel by an operation in which the binding mechanism moves from the binding position to the retreat position, wherein the wire pull-out part includes a pull-out roller configured by a rotating body capable of rotating and having an outer circumferential surface that the wire is to contact, the pull-out roller being provided on a feeding path of the wire between a reel accommodation part in which the reel is accommodated and the binding mechanism, and is configured to move the pull-out roller in a direction in which the wire is pulled out by an operation of the binding mechanism moving from the binding position to the retreat position, and to move the pull-out roller in a direction of getting away from the pulled out wire by an operation of the binding mechanism moving from the retreat position to the binding position, wherein the wire pull-out part includes a transmission part to which an operation of the binding mechanism moving part is transmitted, the transmission part including a first link to which the pull-out roller is attached and a second link connected to the binding mechanism via the binding mechanism moving part, and wherein the transmission part is configured such that an amount of the wire pulled out by the wire pull-out part is different from an amount of movement of the binding mechanism moved by an operation of the binding mechanism moving part.

2. The binding device according to claim 1, wherein the wire pull-out part is configured to pull out the wire from the reel in a direction different from a direction in which the binding mechanism moves between the binding position and the retreat position.

3. The binding device according to claim 2, wherein the binding mechanism moving part is configured to move the binding mechanism in a direction intersecting an arrangement surface of the reinforcing bar.

4. The binding device according to claim 1, wherein, in an operation of the wire pull-out part pulling out the wire from the reel, a load applied to the wire between the wire pull-out part and the reel is made greater than a load applied to the wire between the binding mechanism and the wire pull-out part.

5. The binding device according to claim 1, further comprising a braking part configured to suppress rotation of the reel, the braking part including a braking member configured to move between a braking position where the braking member comes into contact with the reel and a retreat position distant from the reel, and an actuation member that is configured to actuate the braking member.

6. The binding device according to claim 5, wherein the braking part is configured to suppress rotation of the reel when the binding mechanism moves to the retreat position.

7. The binding device according to claim 5, wherein the actuation member is configured to move in accordance with a movement of the binding mechanism, wherein, in a state where the binding mechanism reaches the retreat position, the actuation member makes the braking member contact with the reel.

8. The binding device according to claim 1, wherein the wire pull-out part is configured to move the pull-out roller in a direction of getting away from a vertex of the pulled out wire by the operation of the binding mechanism moving from the retreat position to the binding position.

9. The binding device according to claim 1, wherein the pull-out part includes a one-way clutch that allows rotation of the pull-out roller in one direction, and wherein, in an operation of the wire pull-out part pulling out the wire from the reel, the one-way clutch makes a load applied to the wire between the wire pull-out part and the reel greater than a load applied to the wire between the binding mechanism and the wire pull-out part.

10. The binding device according to claim 1, wherein a length of the wire necessary for binding the reinforcing bar at one action of the binding by the binding mechanism is smaller than a distance from the retreat position to the binding position.

* * * * *